US007393250B2

(12) United States Patent
Tanaka

(10) Patent No.: US 7,393,250 B2
(45) Date of Patent: Jul. 1, 2008

(54) TABLE TAP

(76) Inventor: Hiroaki Tanaka, 5-13-20-101, Zaimokuza, Kamakura-shi, Kanagawa (JP)

( * ) Notice: Subject to any disclaimer, the term of this patent is extended or adjusted under 35 U.S.C. 154(b) by 0 days.

(21) Appl. No.: 10/549,815

(22) PCT Filed: Mar. 17, 2004

(86) PCT No.: PCT/JP2004/003607

§ 371 (c)(1),
(2), (4) Date: May 11, 2006

(87) PCT Pub. No.: WO2004/084361

PCT Pub. Date: Sep. 30, 2004

(65) Prior Publication Data

US 2006/0234561 A1 Oct. 19, 2006

(30) Foreign Application Priority Data

Mar. 19, 2003 (JP) ..... 2003-076102

(51) Int. Cl.
*H01R 25/00* (2006.01)

(52) U.S. Cl. ..... 439/652

(58) Field of Classification Search ..... 439/652, 439/215, 214, 209; 174/101, 97
See application file for complete search history.

(56) References Cited

U.S. PATENT DOCUMENTS 4,278,834 A * 7/1981 Boundy ..... 174/497
4,615,574 A * 10/1986 Dearman ..... 439/592
4,629,826 A * 12/1986 Thomas ..... 174/99 R
4,874,322 A * 10/1989 Dola et al. ..... 439/210
5,089,667 A * 2/1992 Goussin et al. ..... 174/101
5,171,159 A * 12/1992 Byrne ..... 439/215
5,688,132 A * 11/1997 Rogers et al. ..... 439/120
5,941,720 A * 8/1999 Byrne ..... 439/215
6,644,988 B2 * 11/2003 Healy ..... 439/120
6,972,367 B2 * 12/2005 Federspiel et al. ..... 174/481

FOREIGN PATENT DOCUMENTS

| | | |
|---|---|---|
| JP | 49-123591 | 10/1974 |
| JP | 62-107620 | 5/1987 |
| JP | 1-101108 | 7/1989 |
| JP | 6-7182 | 1/1994 |
| JP | 6-19218 | 3/1994 |

(Continued)

OTHER PUBLICATIONS

English Language Abstract of JP 9-63723.

(Continued)

*Primary Examiner*—Alexander Gilman
(74) *Attorney, Agent, or Firm*—Greenblum & Bernstein, P.L.C.

(57) ABSTRACT

A power strip includes two or more spaced-apart sockets each having a set of terminal insertion holes for insertion of plug terminals of a power cable or the like and either at least one flexible joint that interconnects adjacent sockets or a flexible cover of substantially tubular shape that substantially covers and interconnects the sockets. The interconnection of the sockets by the flexible joints or the flexible cover. enables the spaces between adjacent sockets to be optimized for the types and numbers of plugs, AC adapters and the like to plugged into the sockets.

10 Claims, 20 Drawing Sheets

FOREIGN PATENT DOCUMENTS

| | | |
|---|---|---|
| JP | 6-292317 | 10/1994 |
| JP | 9-63723 | 3/1997 |
| JP | 11-111377 | 4/1999 |
| JP | 2002-354634 | 12/2002 |

OTHER PUBLICATIONS

English Language Abstract of JP 6-292317.
English Language Abstract of JP 11-111377.
English Language Abstract of JP 2002-354634.

* cited by examiner

TABLE TAP

BACKGROUND OF THE INVENTION

1. Field of the Invention

The present invention relates a power strip for supplying commercial AC power to any of number of electrical devices such as a personal computer, television set or audio device, particularly to a power strip provided with multiple sockets whose spacing and positional relationship can be modified.

2. Description of Related Art

Power strips are used, for example, when the number of available wall sockets is insufficient or when the electrical device to be supplied with power is located at a distance from the wall socket. The power strip is particularly useful for personal computer users, who often simultaneously need to use a number of independently powered peripheral devices such as a printer, modem, hub, digital camera and the like. Such peripheral devices generally need to be supplied with electricity from an outlet that is near the computer unit. Use of a power strip having numerous sockets may become necessary. In some cases, two or more power strips may be needed.

Conventional power strips include, for instance, ones whose main unit is a block (rectangular solid) resembling a flat rod. The upper surface of the block is provided with a number of regularly spaced pairs of terminal insertion holes that are individually provided internally with socket elements. The socket elements are electrically connected to a connection cable provided inside the power strip main unit. The connection cable is connected to an electrical cord that passes out of power strip main unit and is formed at its extremity with a plug for insertion into a wall socket. After the plug has been inserted into a socket and the power strip main unit has been placed at the desired location, various electronic devices can be supplied with electric power by inserting the plugs of their power cables into the terminal insertion holes (sockets) of the power strip main unit.

The multiple sets of terminal insertion holes provided in the main unit of the conventional power strip are ordinarily formed at regular intervals. On the other hand, some computer peripheral devices use AC adapters that differ in shape and size from one device to another. When a large AC adapter is plugged into a pair of terminal insertion holes (a socket) of the conventional power strip, therefore, it is likely to obstruct one or both of the neighboring sockets. This may limit the number of AC adapters and plugs that can be plugged into the power strip.

An inconvenience may also arise when using multiple peripheral devices that do not require AC adapters and are equipped with power cables that end in an ordinary plug. Although such plugs do not obstruct adjacent sockets, they come to be plugged in very near each other (or an AC adapter) owing to the small intervals between neighboring sockets. The close spacing of the sockets therefore makes it difficult to insert and pull out the plugs.

The intervals between the multiple sockets of the power strip are set to the minimum required during use. The length of the power strip therefore tends to become long when a large number of sockets are provided. A power strip having more sockets than are actually used therefore takes up more space than required and may be impossible to install in the available space. Its excessive length may also make it inconvenient to carry when traveling.

A conventional power strip has the general shape of a flat rod-like block. This shape is not ideal for stable installation.

When installed within a prescribed region on a desk or the like, the power strip may inadvertently fall off or cause other use-related problems.

In order to allow the power cable of a peripheral device to extend from the power strip in the desired direction, the cable may need to be forcibly bent for insertion into a power strip socket. The strain applied to the power cable or its plug in this case may cause wire breakage.

The present invention was accomplished in light of the foregoing circumstances and has as its object to provide a power strip that has a flexible structure enabling intervals between multiple sets of terminal insertion holes (sockets) to be expanded from a minimum length up to a prescribed limit length and to be bent or bowed, thereby enabling all sets of terminal insertion holes to be effectively utilized even when plugging in large AC adapters and also enabling plugs and the like to be inserted and pulled out with ease, and that even when provided with a large number of sets of terminal insertion holes is not inconvenient to install or carry but can be installed in a stable state to allow a power cable to extend in a desired direction without putting it under strain.

SUMMARY OF THE INVENTION

A power strip according to a first aspect of the invention comprises two or more spaced-apart socket sections each having a set of terminal insertion holes for insertion of plug terminals of a power cable or the like and at least one flexible joint section that interconnects adjacent socket sections.

In this aspect of the invention, the socket sections are interconnected by flexible joint sections. Therefore, when a large AC adapter is to be plugged in, the spaces between neighboring socket sections can be expanded to ensure that no unused socket gets hidden under the AC adapter. Moreover, the spaces between the socket sections can be expanded to form sufficient space for finger insertion when inserting or pulling out an AC adapter or plug. Moreover, the length of the power strip can be reduced to nearly minimum for easy installation or carrying by compressing the spaces between the socket sections to near minimum. In addition, the power strip can be bent and/or twisted to deform it into a bent or bowed shape optimized to the installation site, thereby increasing its stability at the installation site. Such bending and bowing makes it possible to extend power cables in the desired direction without putting them under strain.

A power strip according to a second aspect of the invention comprises two or more spaced-apart socket sections each having a set of terminal insertion holes for insertion of plug terminals of a power cable or the like and a flexible cover section of substantially tubular shape that substantially covers and interconnects the socket sections.

In this aspect of the invention, the socket sections are substantially covered and interconnected by the flexible cover section. Therefore, when a large AC adapter is to be plugged in, the spaces between neighboring socket sections can be expanded to ensure that no unused socket gets hidden under the AC adapter. Moreover, the spaces between the socket sections can be expanded to form sufficient space for finger insertion when inserting or pulling out an AC adapter or plug. Moreover, the length of the power strip can be reduced to nearly minimum for easy installation or carrying by compressing the spaces between the socket sections to near minimum. In addition, the power strip can be bent and/or twisted to deform it into a bent or bowed shape optimized to the installation site, thereby increasing its stability at the installation site. Such bending and bowing makes it possible to extend power cables in the desired direction without putting them under strain.

A power strip according to a third aspect of the invention is characterized in that the aforesaid joint section or cover section is given a substantially tubular shape.

The tubular shape of the joint sections or cover section enables a cable and the like to be passed through the interior for establishing electrical connection among the socket sections.

A power strip according to a fourth aspect of the invention is characterized in that the aforesaid joint section or cover section has a tubular shape formed with corrugations.

The formation of the joint sections or cover section with corrugations imparts the associated regions with flexibility that enables the spaces between the socket sections be expanded or compressed and the socket sections to be bent and twisted relative to one another.

Since the joint sections are covered and interconnected by the cover section, the spaces between the socket sections can be expanded or compressed and the socket sections can be bent and twisted relative to on another.

A power strip according to a fifth aspect of the invention is characterized in that the full circumference of the aforesaid cover section or joint section is formed with corrugations that intersect the longitudinal direction of the cover section.

The corrugated sections formed about substantially the full circumference of the joint sections or cover section imparts flexibility that enables the spaces between the socket sections be expanded or compressed and the socket sections to be bent and twisted relative to one another.

A power strip according a sixth aspect of the invention is characterized in that the outer peripheral surfaces of the socket sections are formed with bumps and dips that mesh with the aforesaid cover section or joint section.

The bumps and dips formed on the socket sections mesh with at least part of the cover section or joint sections, thereby preventing the socket sections and cover section from shifting relative to one another.

A power strip according to a seventh aspect of the invention is characterized in that the aforesaid cover section is formed with substantially no corrugations at the portions where the aforesaid socket sections are located and is formed with corrugations at a portion between adjacent socket sections.

Since corrugations are not formed at a socket section, this portion of the cover section can be brought into close contact with surface of the associated socket section insofar as the surface of the socket section is smooth. Reliable adhesion or bonding can therefore be achieved.

A power strip according to an eighth aspect of the invention is characterized in that the aforesaid bumps and dips have an undulating shape that fits into the corrugations of the cover section or joint section.

The outer peripheral surfaces of the socket sections are formed with bumps and dips that mesh with the corrugations. Therefore, when covering the socket sections with the cover section or joint sections, it is possible at the socket sections to mesh the corrugations of the cover section or joint sections and the bumps and dips of corrugated shape of the socket sections, thereby integrating them. Moreover, if the corrugations and the bumps and dips are bonded, the cover section or joint section and the socket sections are closely contacted in a fitted manner to reduce shifting.

A power strip according to a ninth aspect of the invention is characterized in that the outer surface of the aforesaid joint section or cover section, or portions of the outer surfaces of the aforesaid socket sections exposed outside the aforesaid joint section or cover section are subjected to nonslip processing or treatment, or at least the surface layers thereof are formed of a material having a nonslip effect.

The nonslip property obtained by subjecting the outer surface of the joint section or cover section, or the portions of the outer surfaces of the socket sections exposed outside the joint section or cover section, to nonslip processing or treatment or by forming them of material having a nonslip effect inhibits inadvertent movement of the power strip by producing a frictional action when a load tending to move the power strip acts thereon.

A power strip according to a tenth aspect of the invention is characterized in that the sets of terminal insertion holes formed at the socket sections fall along an imaginary line and the aforesaid joint section or cover section has a structure enabling it to flex at least along the imaginary line.

This enables a flexing action that, for example, causes the socket sections to approach and depart from one another in the direction of the imaginary line.

A power strip according to an eleventh aspect of the invention is characterized in that the sets of terminal insertion holes formed at the aforesaid socket sections are spaced a prescribed distance apart in a direction intersecting the imaginary line and the aforesaid joint section or cover section has a structure enabling it to flex at least along the direction intersecting the imaginary line.

This enables a flexing action that, for example, causes the socket sections to approach and depart from one another in the direction intersecting the imaginary line.

A power strip according to a twelfth aspect of the invention is characterized in that it includes a set of sockets whose sets of terminal insertion holes are formed at the socket sections to be located along an imaginary line and a set of sockets whose sets of terminal insertion holes are formed at the socket sections to be located substantially in parallel as spaced a prescribed distance apart in a direction intersecting the imaginary line, in which power strip it is either possible for the aforesaid joint section or cover section to flex at least along the imaginary line or possible for the aforesaid joint section or cover section to flex at least along the direction intersecting the imaginary line.

This enables flexing actions that, for example, cause the socket sections to approach and depart from one another in the direction of the imaginary line and cause the socket sections to approach and depart from one another in the direction intersecting the imaginary line.

A power strip according to a thirteenth aspect of the invention is characterized in that the aforesaid joint section or cover section is integrally connected and fastened.

The joint section or cover section can, for example, be integrally connected and fastened to the socket sections by a bonding process or molding process. This improves bonding strength and bonding quality and also enhances productivity.

DESCRIPTION OF THE PREFERRED EMBODIMENTS

Preferred embodiments of the power strip according to the invention will now be explained with reference to the drawings.

First Embodiment

Figure 1:
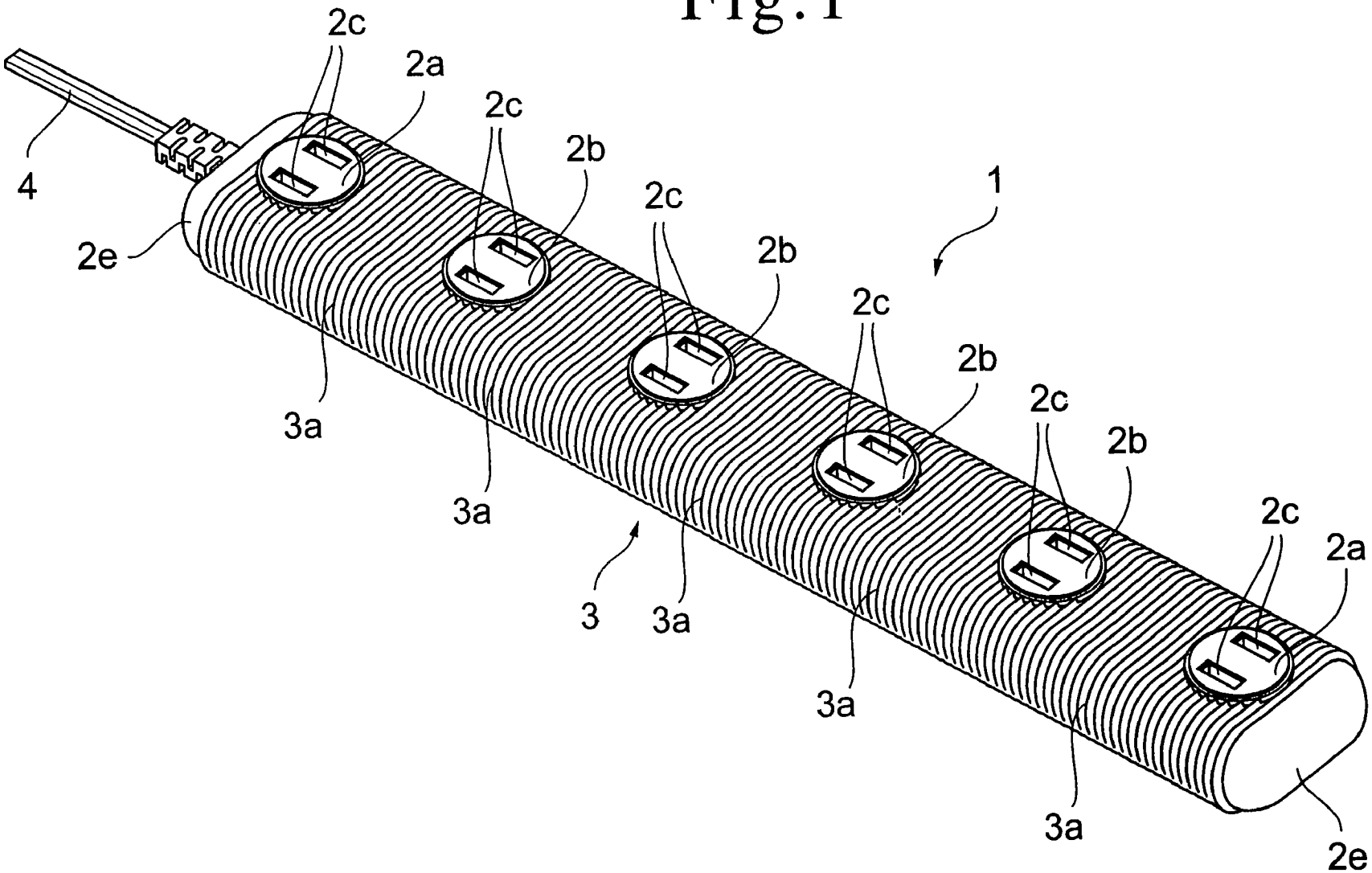
FIG. 1 is a perspective overview of a power strip that is a first embodiment of the invention.

A power strip 1 that is a first embodiment of the invention is shown in FIGS. 1 to 9. FIG. 1 is an overview of the power strip 1. The power strip 1 has a socket 2*a* at either end and a number of sockets 2*b* (four in the illustrated power strip 1) spaced between the two sockets 2*a*. The total number of sockets 2*a*, 2*b* is therefore six. The sockets 2*a*, 2*b* are individually formed with pairs of terminal insertion holes 2*c* for insertion of the plugs of power cables connected with electrical devices, peripheral devices and the like and the terminals of AC adapters. The sockets 2*a*, 2*b* of the power strip 1 are located so that the sets of terminal insertion holes 2*c* formed at the sockets 2*a*, 2*b* are located along an imaginary straight line.

The regions surrounding of the sockets 2*a*, 2*b* are covered by a tubular cover 3 imparted with flexibility by formation of numerous corrugations 3*a*. This provides the power strip 1 with a structure that enables the cover 3 to flex at least along the imaginary line. A power cable 4 extends outward from the socket 2*a* at one end of the power strip 1. The extremity of the power cable 4 is equipped with a plug (not shown) for insertion into a wall socket, for example.

Figure 2:
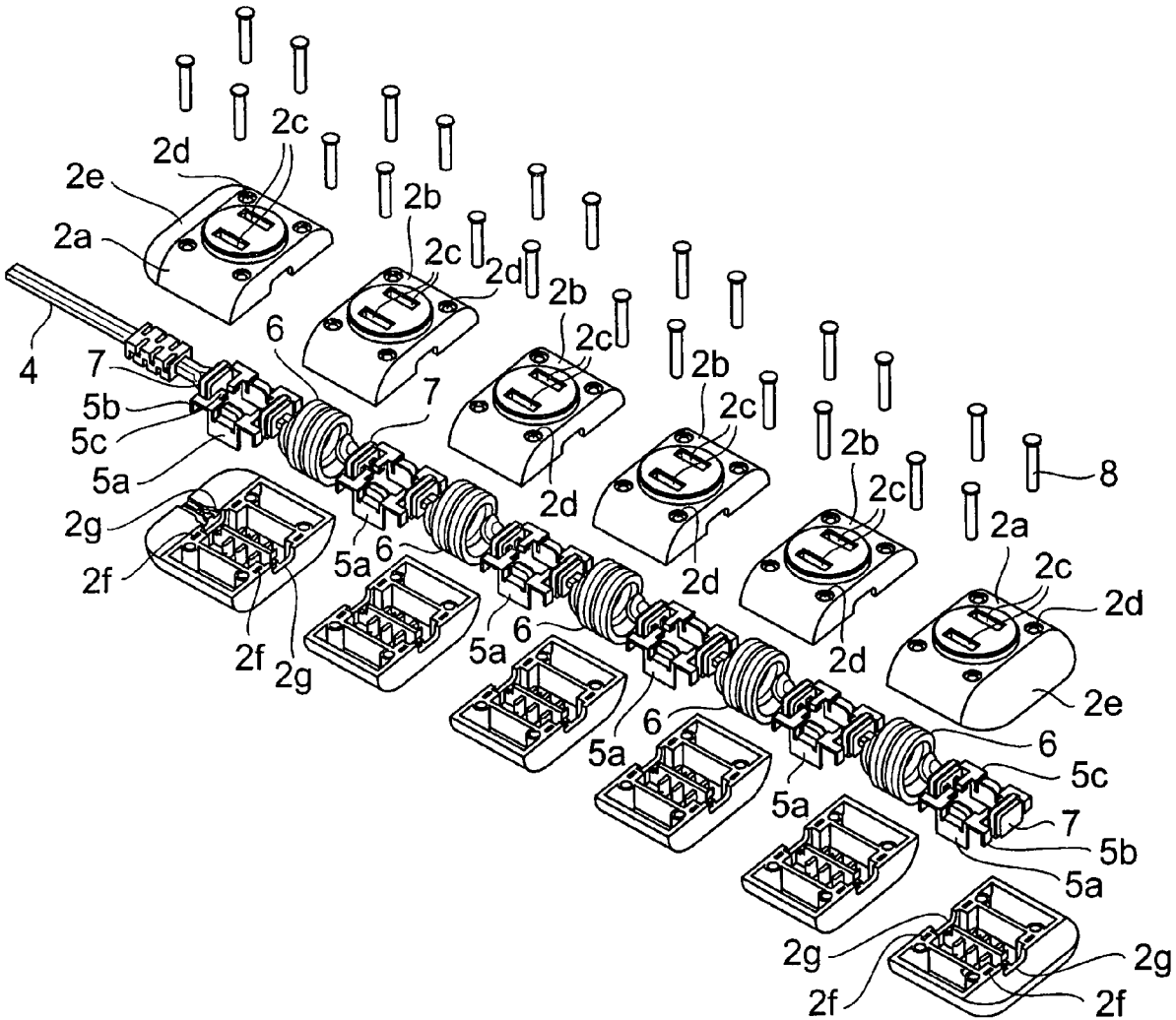
FIG. 2 is an exploded perspective view showing the internal structure of the power strip of FIG. 1.
Figure 3:
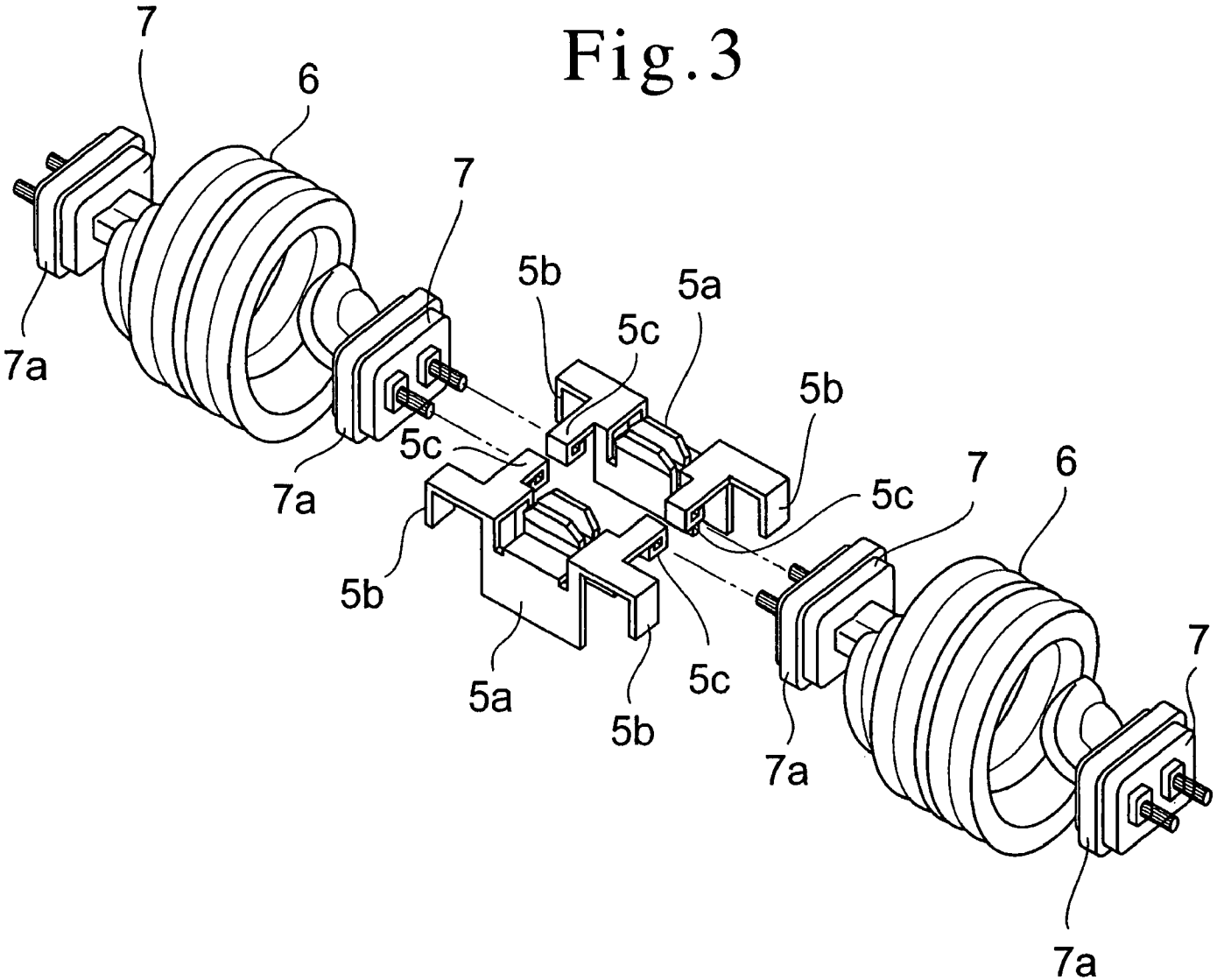
FIG. 3 is a partial exploded perspective view showing the internal structure of the power strip of FIG. 1.

The internal structure of the power strip 1 will now be explained with reference to FIGS. 2 to 4. As shown in FIG. 2, each socket 2*a*, 2*b* has an overall split structure composed of assembled upper and lower members. The shapes of the sockets 2*a* and sockets 2*b* are differentiated from the functional viewpoint. The sockets 2*a* located at the opposite ends are integrally formed at one end with an end member 2*e* exposed outward from the end of the cover 3. The sockets 2*b* located between the two sockets 2*a* are not formed with such end members 2*e*. This structure including the end members 2*e* is adopted in view of the need to close the ends of the cover 3.

The surfaces of the end members 2*e* can be subjected to surface treatment (e.g., rubber coating treatment) so as to impart them with nonslip property. This surface treatment helps prevent the power strip 1 from slipping. Instead of conducting such surface treatment, it is possible form the end member 2*e* itself of rubber or the like and fasten it to the end portion of a member shaped like the socket 2*b* by bonding or force-fitting.

A terminal plate 5*a* is installed in association with each of the two terminal insertion holes 2*c* at each socket 2*a*, 2*b*. A first extension 5*c* and first projection 5*b* are integrally formed at one end of each terminal plate 5*a*. The terminal plates 5*a* are attached to the associated sockets 2*a*, 2*b* by fitting the first projections 5*b* into recesses 2*f* in the lower members (lower as viewed in the drawings) of the split structures. One of the two conductors of the power cable 4 is connected to the first extension 5*c* of the terminal plate 5*a* located on the side of the power cable 4 by crimping or other such method. A cast resin spacer 7 is attached to the two conductors of the power cable 4 to insulate them from each other. The spacer 7 has the shape of a thin block integrally formed at its edge with an endless projection 7*a*. The projection 7*a* is positioned at the inside of rectangular notches 2*g* formed in the upper and lower members of the associated socket 2*a*. The engagement of the projection 7*a* with the notches 2*g* prevents extraction of the two conductors of the power cable 4 and also prevents wire breakage and the like under a strain-producing load. Similar effects are also realized by installing projections 7*a* in association with cables 6 (see below).

A second extension 5*c* and second projection 5*b* are integrally formed at the other end of each terminal plate 5*a*. One of the two conductors of a connecting cable 6 is similarly connected to each second extension 5*c*. A cast resin spacer 7 is attached to the two conductors of the connecting cable 6. The spacer 7 is inserted into the notches 2*g* formed in the upper and lower members of the associated socket 2*a*, 2*b*. Each conductor of the connecting cable 6 is connected through a spacer 7 to the extension 5*c* of the adjacent terminal plate 5*a*.

As shown in FIGS. 2 to 5, the connecting cables 6 are coiled. This is for providing the connecting cables 6 with a degree of expandability for accommodating positional changes between a socket 2*a* and a socket 2*b* or between sockets 2*b*. The coiled configuration ensures that the connecting cables 6 do not get tangled or shifted before or after expansion or compression of the space between the sockets.

The terminal plates 5*a* installed in association with the six sockets 2*a*, 2*b* are interconnected by the connecting cables 6. The extensions 5*c* of the terminal plates 5*a* nearest the tip end are attached with a spacer 7 that is inserted into the notches 2*g* formed in the upper and lower members of the associated socket 2*a*. This spacer 7 has the same shape as the other spacers 7 but is different in function, namely it does not serve to prevent wire breakage.

Figure 4:
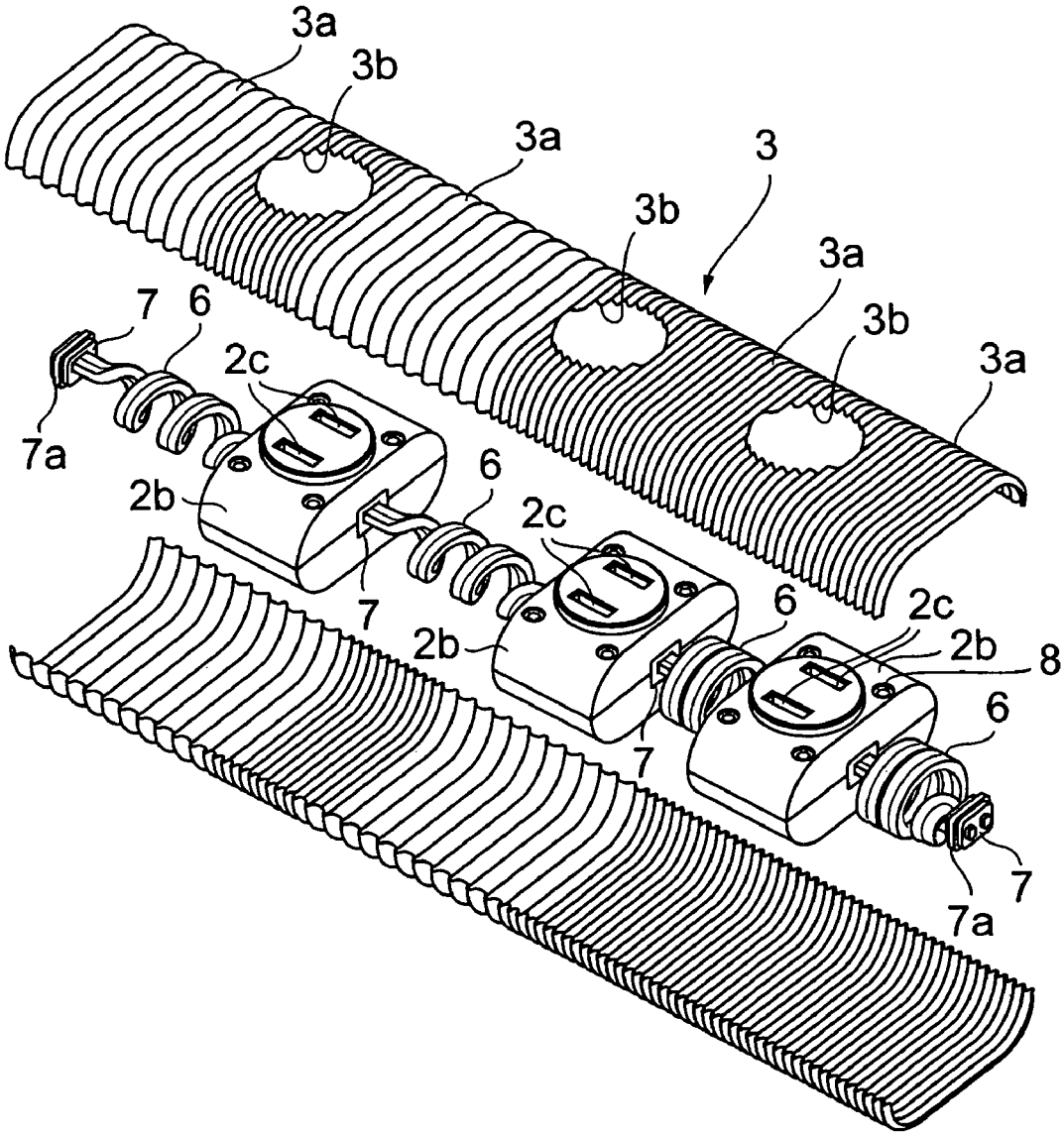
FIG. 4 is a partial exploded perspective view showing the internal structure of the power strip of FIG. 1.

After the six sets of terminal plates 5*a* and spacers 7 for the six sockets 2*a*, 2*b* have been clamped between the members of the split structures, pins 8 are inserted or forced into through-holes 2*d* formed at the four corners of the sockets 2*a*, 2*b* to integrally assemble the sockets 2*a*, 2*b* (see FIG. 4).

The cover 3 is formed at substantially regular intervals with six round through-holes 3*b* for inserting round protrusions formed with the terminal insertion holes 2*c* of the sockets 2*a*, 2*b*. After the sockets 2*a*, 2*b* have been integrally assembled, the round protrusions of the sockets 2*a*, 2*b* are inserted into the through-holes 3*b* to attach the cover 3 to the outer peripheral surface of the sockets 2*a*, 2*b*. As can be seen in FIG. 1, the corrugations 3*a* are initially compressed to minimize the space between them, so that the sockets 2*a*, 2*b* are interconnected and maintained at substantially regular intervals by the cover 3. The cover 3 is tubular. Therefore, the sockets 2*a*, 2*b* are internally accommodated in a substantially sealed state and the connecting cables 6 interconnecting the sockets 2*a*, 2*b* are accommodated in a freely expandable and contractible condition.

The attachment of the cover 3 to the sockets 2*a*, 2*b* can be done simply by covering the sockets 2*a*, 2*b* with the cover 3 or can be done by first applying an adhesive to the outer peripheral surfaces of the sockets 2*a*, 2*b* and then covering the sockets 2*a*, 2*b* with the cover 3. When the cover 3 is adhered to the sockets 2*a*, 2*b* using and adhesive, the cover 3 is safe from detachment from the sockets 2*a*, 2*b* when the corrugations 3*a* of the cover 3 are expanded. The peaks of the corrugations 3*a* and sockets 2*a*, 2*b* are adhered in contact through the adhesive and the adhesive also penetrates the valleys formed by the corrugations so as to ensure strong bonding.

The outer peripheral surfaces of the sockets 2*a*, 2*b* shown in FIG. 4 are substantially flat. Contact with the corrugations 3*a* is therefore limited to contact with the peaks of the corrugations 3*a*. Shifting and/or detachment is therefore liable to occur not only when the cover 3 is attached without using an adhesive but even when it is attached using an adhesive if the engagement and/or adhesion between the cover 3 and the sockets 2*a*, 2*b* should be inadequate.

Figure 5:
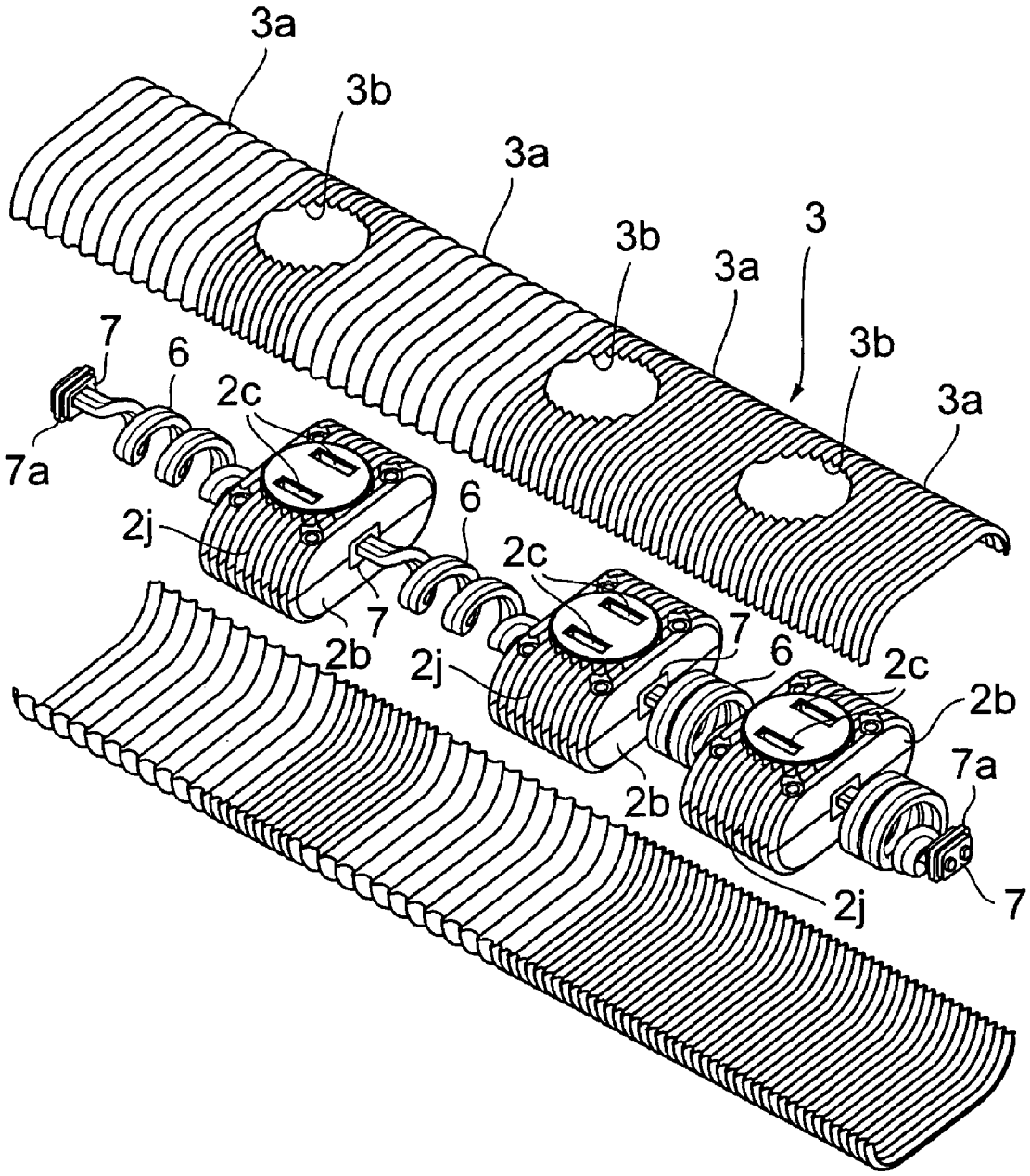
FIG. 5 is a partial exploded perspective view showing a modification of the internal structure of the power strip of FIG. 1.

The risk of the cover 3 shifting relative to or detaching from the sockets 2*a*, 2*b* is preferably minimized by, as shown in FIG. 5, forming the outer peripheral surfaces of the sockets 2*a*, 2*b* with many encircling grooves 2*j* to create bumps and dips that can engage with the corrugations 3*a* of the cover 3.

In this case, when the cover 3 is attached to the sockets 2*a*, 2*b*, the corrugations 3*a* of the cover 3 fit into the encircling grooves 2*j* formed in the sockets 2*a*, 2*b* to prevent shifting of the engagement when, for example, the cover 3 is expanded with respect to the sockets 2*a*, 2*b*. When the sockets 2*a*, 2*b* and the cover 3 are integrally adhered using an adhesive, the corrugations 3*a* are tightly adhered to the outer surfaces of the encircling grooves 2*j* not only at the bottoms of their valleys but substantially throughout the inner surfaces of the corrugations 3*a*, thus strongly bonding the cover 3 to the sockets 2*a*, 2*b* and making detachment highly unlikely.

Figure 6:
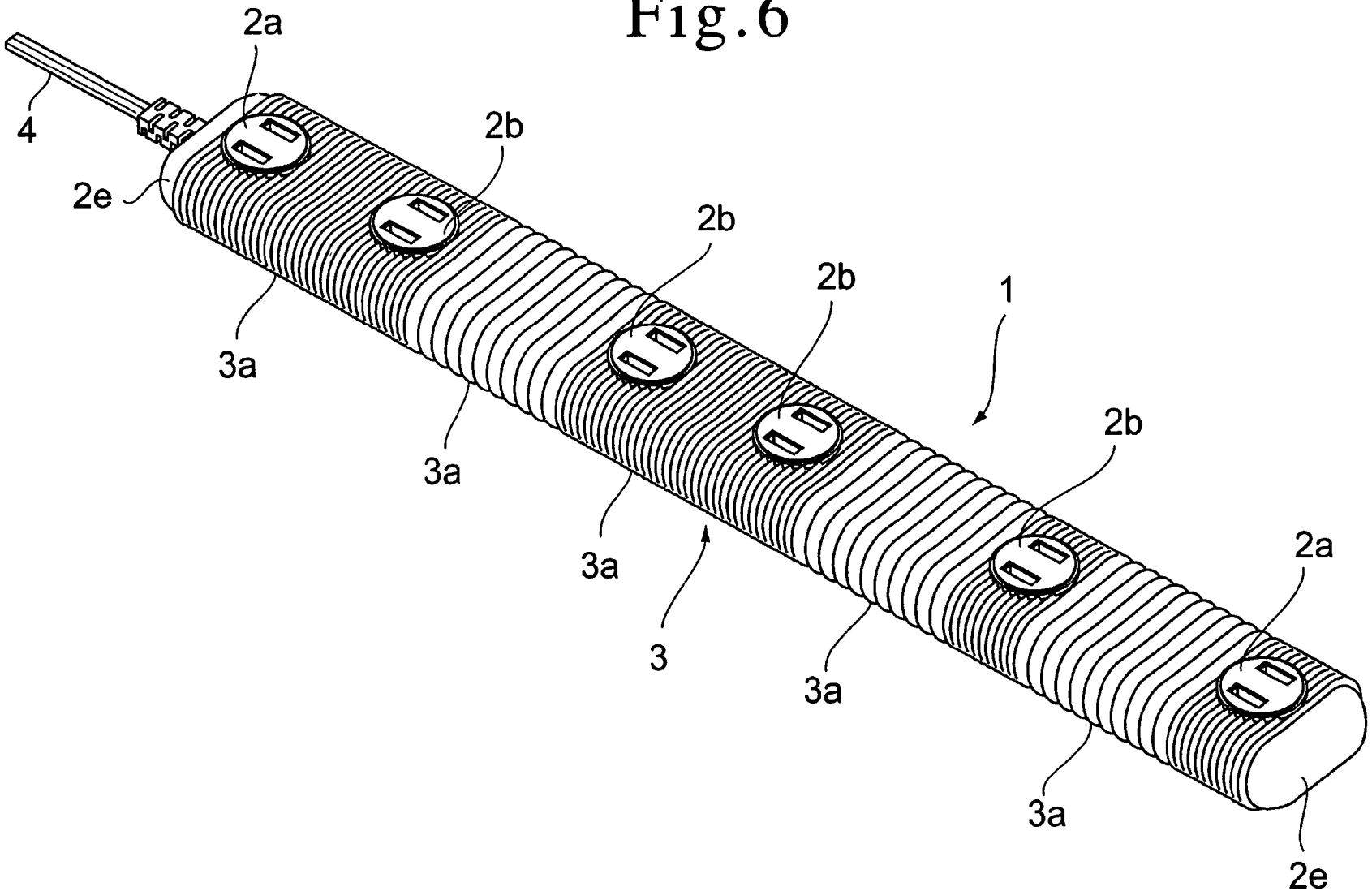
FIG. 6 is perspective view showing an example of how the power strip of the FIG. 1 might be used.

The advantageous effects achieved by the power strip 1 will be explained. In the power strip 1, the cover 3 attached to cover the sockets 2*a*, 2*b* is formed with the corrugations 3*a*. Therefore, as shown in FIG. 6, it is possible by longitudinally stretching corrugations 3*a* located between adjacent sockets 2*a*, 2*b* to expand the distances between adjacent sockets 2*a*, 2*b* and thus expand the distances between adjacent pairs of terminal insertion holes 2*c*. This makes it easier to plug in a large AC adapter or the like.

Figure 7:
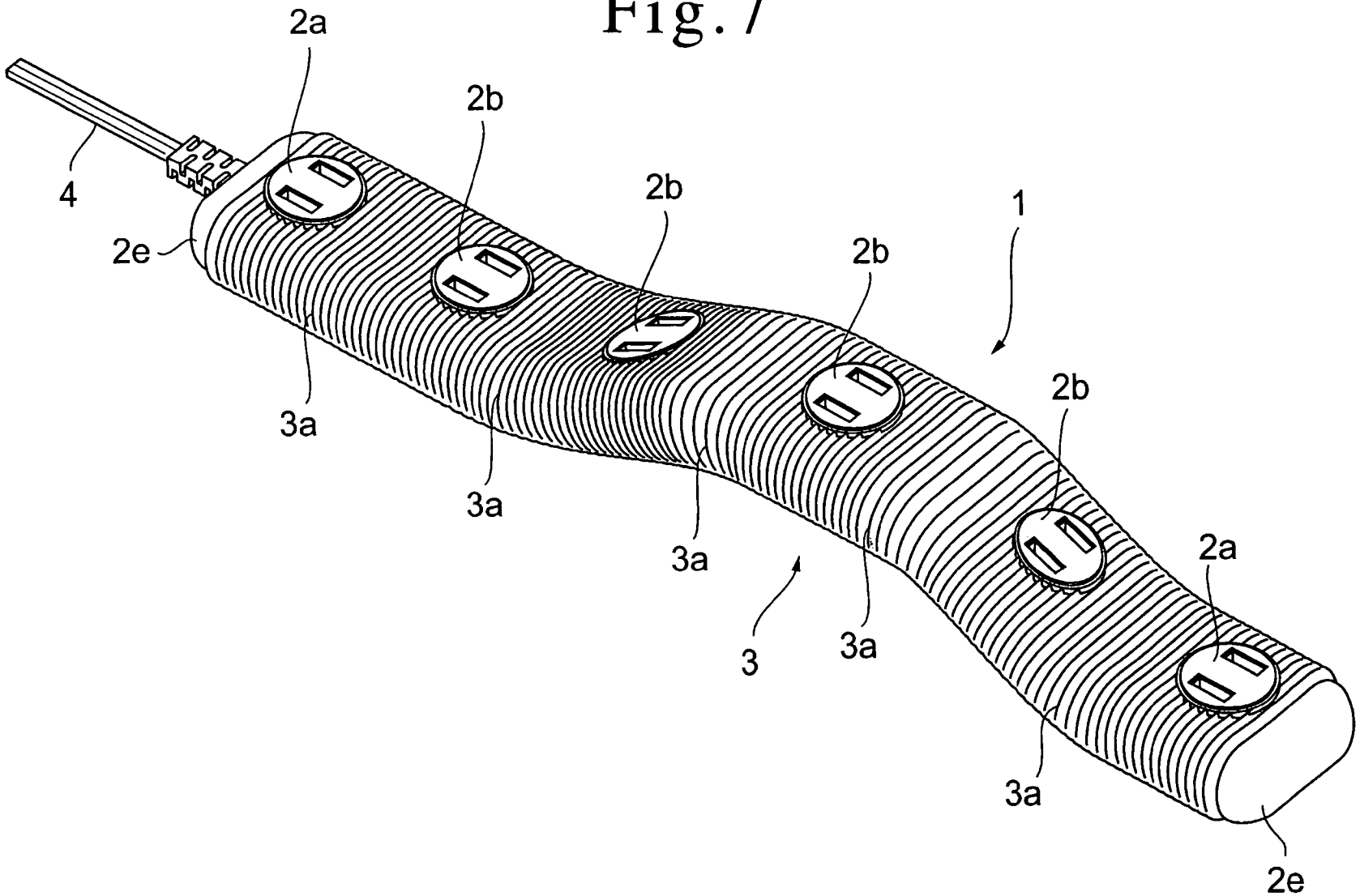
FIG. 7 is perspective view showing another example of how the power strip of FIG. 1 might be used.
Figure 8:
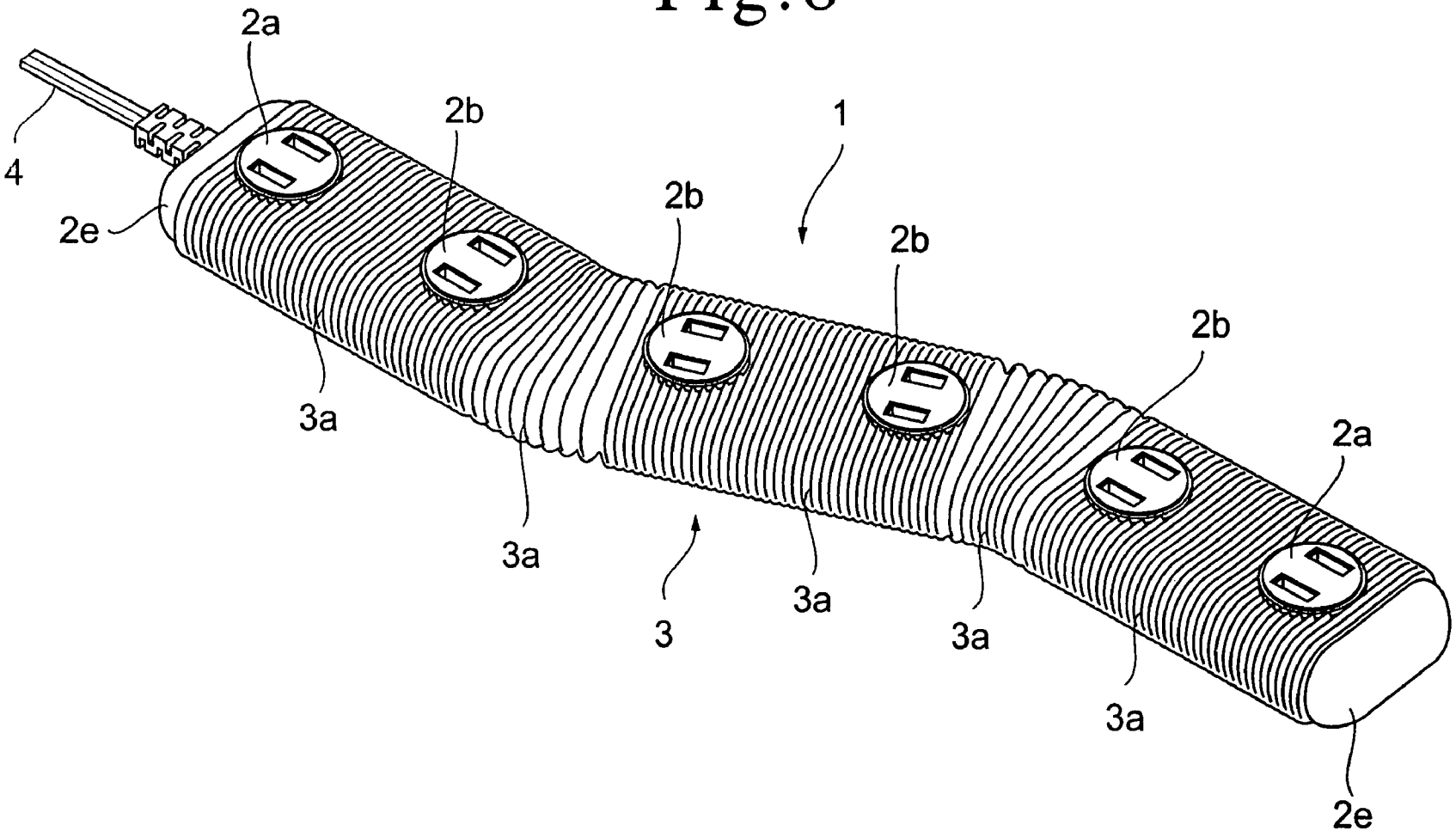
FIG. 8 is perspective view showing another example of how the power strip of FIG. 1 might be used.

Owing to the fact that the sockets 2*a*, 2*b* are covered by the cover 3 formed with the corrugations 3*a*, the corrugations 3*a* located between the sockets 2*a*, 2*b* can be utilized not only for expansion and compression as shown in FIG. 6 but also for changing the shape of the power strip 1 as shown in FIGS. 7 and 8.

FIG. 7 shows a bowed state achieved by deforming the two sets of corrugations 3*a* sandwiching the third socket (2*b*) from the tip of the power strip 1 so as to project this portion upward. The bowing of the power strip 1 in this manner forms a gap under the bowed portion that can be utilized to avoid interference with a part, cable or the like situated underneath.

FIG. 8 shows a snaking state achieved by deforming the two sets of corrugations 3*a* located between the second and third sockets from either end in opposite directions, thereby bending these portions to the left and right. The bowing of the power strip 1 in this manner makes it possible to avoid interference with peripheral devices installed near the power strip 1, thereby improving the stability of power strip 1 installation. Such bending and bowing also can be used to face a socket in a direction that makes it easier to extend a power cable in a desired direction without putting the cable or its plug under excessive strain, thus lowering the probability of wire breakage.

Figure 9:
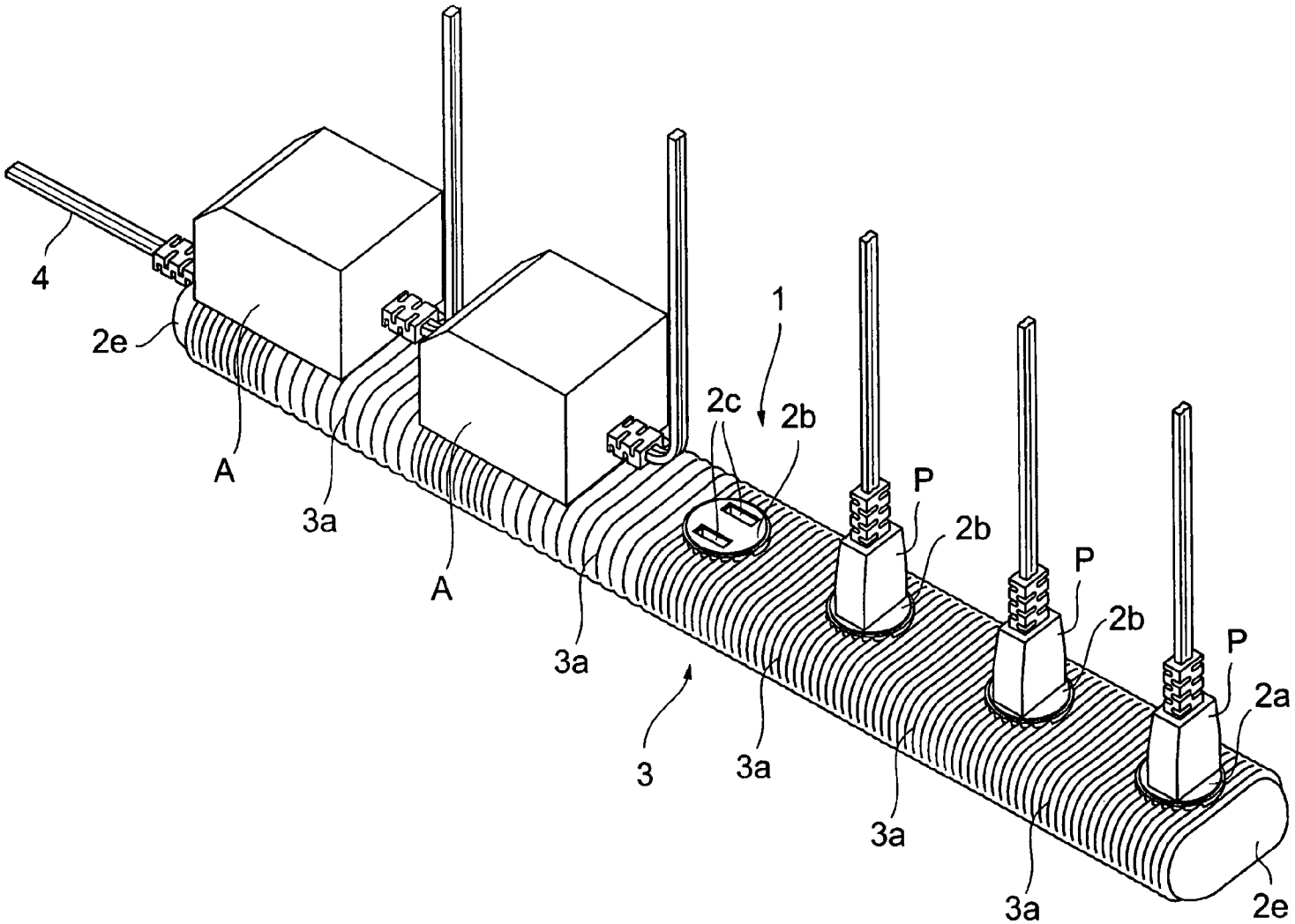
FIG. 9 is perspective view showing another example of how the power strip of FIG. 1 might be used.

FIG. 9 shows the power strip 1 with AC adapters A and plugs P plugged in its terminal insertion holes 2*c* (sockets). Insertion of large AC adapters A into the sockets can be readily accommodated without obstructing neighboring sockets simply by expanding the spaces between adjacent sockets. Moreover, the spaces between the sockets 2*a*, 2*b* can be expanded and regulated so as to enable a plug P plugged into any given pair of terminal insertion holes 2*c* to be inserted or pulled out without interfering with other plugs etc.

Second Embodiment

Figure 10:
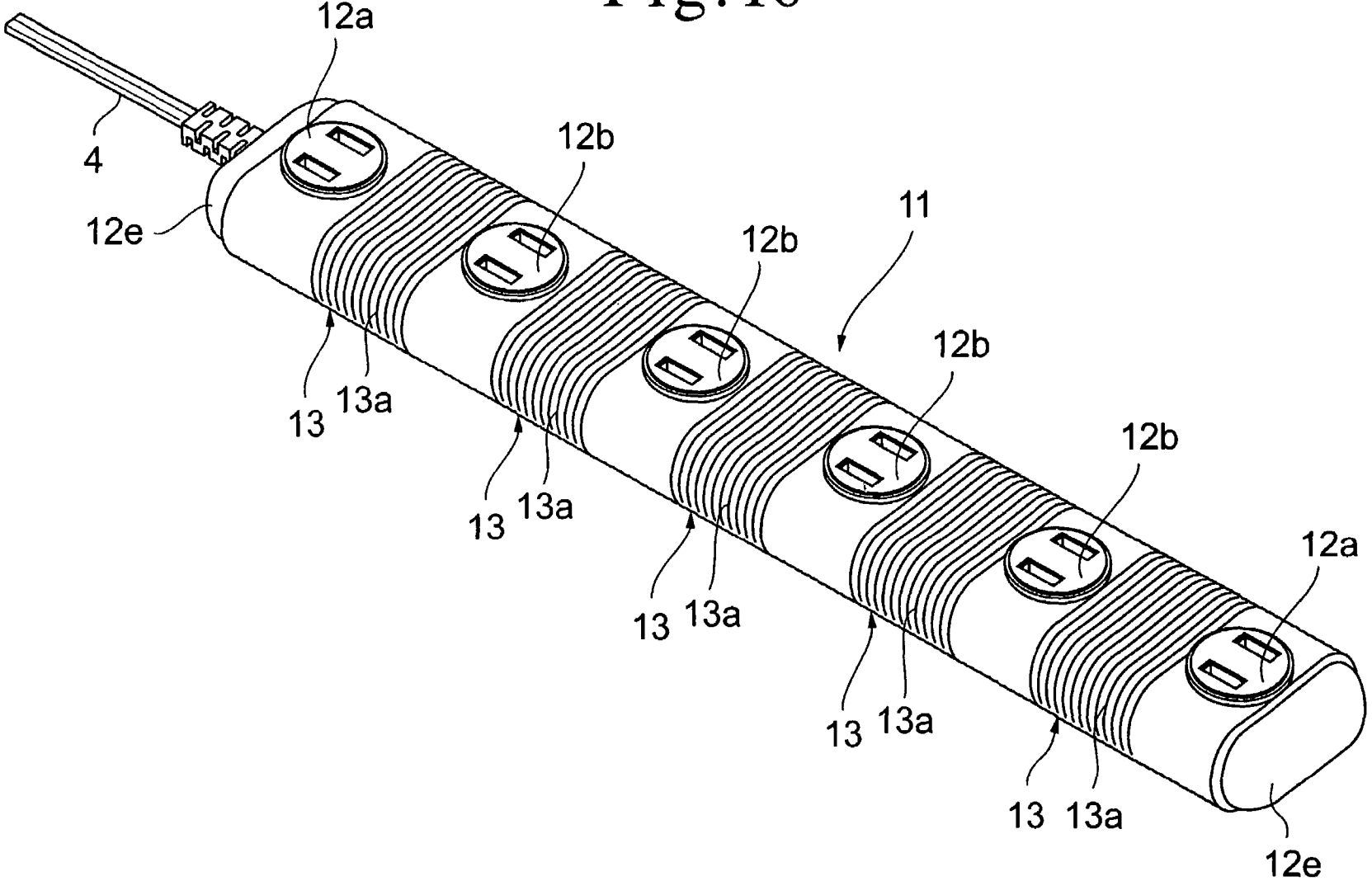
FIG. 10 is a perspective overview of a power strip that is a second embodiment of the invention.
Figure 11:
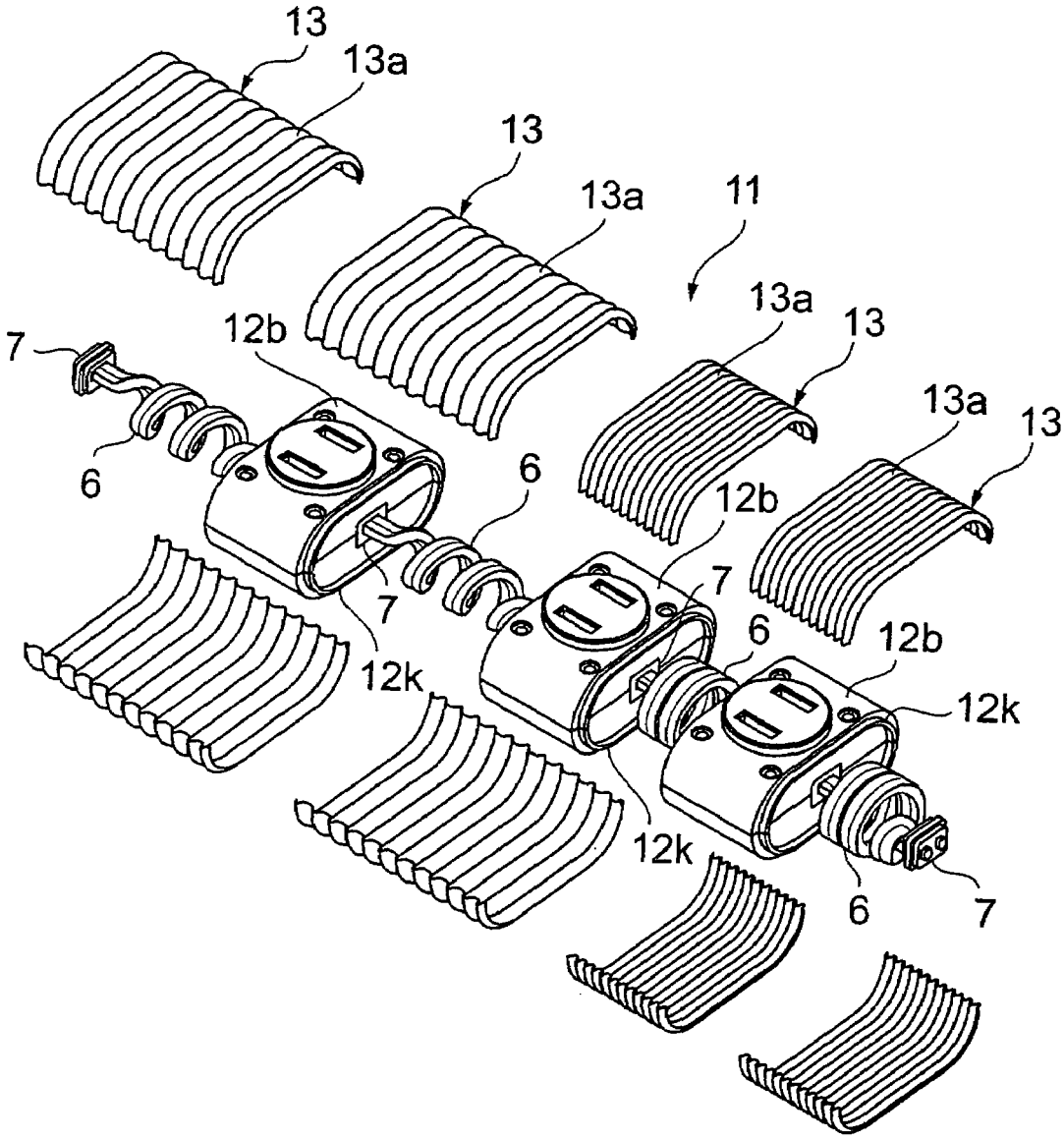
FIG. 11 is a partial exploded perspective view showing the internal structure of the power strip of FIG. 10.

A power strip 11 that is a second embodiment of the invention is shown in FIGS. 10 and 11. Elements of the second embodiment that are the same as those of the first embodiment are assigned the same reference symbols as their counterparts in the first embodiment and will not be explained again here. As shown in FIG. 11, the power strip 11 comprises sockets 12*a*, 12*b* having the same structure as the sockets 2*a*, 2*b* of the power strip 1. The end faces of the sockets 12*a*, 12*b* are formed with annular projections 12*k* and tubular joints 13 formed with corrugations 13*a* are fit on the outer peripheral surfaces of the annular projections 12*k* so as to interconnect the sockets 12*a*, 12*b* as shown in FIG. 10. The engagement strength between the annular projections 12*k* of the sockets 12*a*, 12*b* and the joints 13 can be increased by bonding the members with an adhesive. It is also possible to form at least the end regions of the joints 13 of an elastic material (e.g., rubber) for elastic engagement with the annular projections 12*k*.

The power strip 11 exemplifies a case in which the sockets 12*a*, 12*b* are interconnected by discretely formed joints 13. Alternatively, the sockets 12*a*, 12*b* can be interconnected using a tubular cover obtained by alternately and integrally installing between the sockets 12*a*, 12*b* corrugated sections and plain, corrugation-free tubular sections formed to match to the sockets 12*a*, 12*b*.

In the power strip 11, the joints 13 are attached to the annular projections 12*k* of the sockets 12*a*, 12*b*, and the outer peripheral surfaces of the sockets 12*a*, 12*b* and the outer surfaces of the corrugations 13*a* are positioned in substantially the same plane, i.e., are made flush with one another. This flush configuration minimizes level differences among the corrugations 13*a* and sockets 12*a*, 12*b*, thereby reducing the probability of catching and other problems at the time of installation.

Another alternative is to interconnect and fasten the sockets 12*a*, 12*b* using joints 13 whose end regions ride on the edges of the sockets 12*a*, 12*b*. In this case, it is possible either to unite the joints and sockets by superimposing and bonding them or to unite them by binding them together using clamping bands. The likelihood of detachment can be minimized by integrally forming the edge regions of the sockets 12*a*, 12*b* with encircling ridges similar to what is shown at 2*j* in FIG. 5 for meshing with the corrugations 13*a*.

The power strip 11 according to this embodiment enables the spaces between the sockets 12*a*, 12*b* to be expanded and modified by expanding, compressing, bending, bowing and otherwise deforming the joints 13 comprising the corrugations 13*a*. As such, it achieves substantially the same advantageous effects as the foregoing power strip 1.

Third Embodiment

Figure 12:
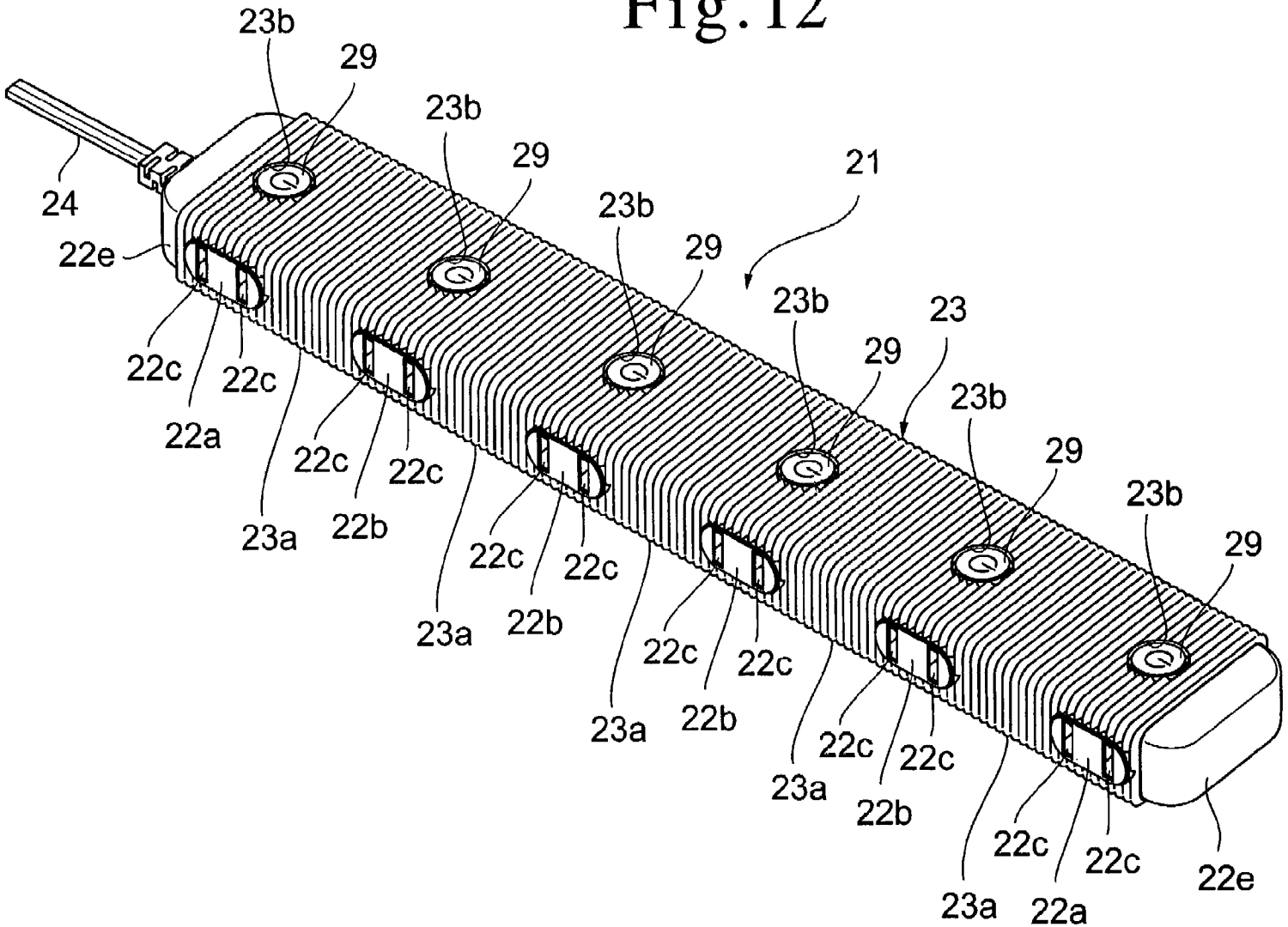
FIG. 12 is a perspective overview of a power strip that is a third embodiment of the invention.
Figure 13:
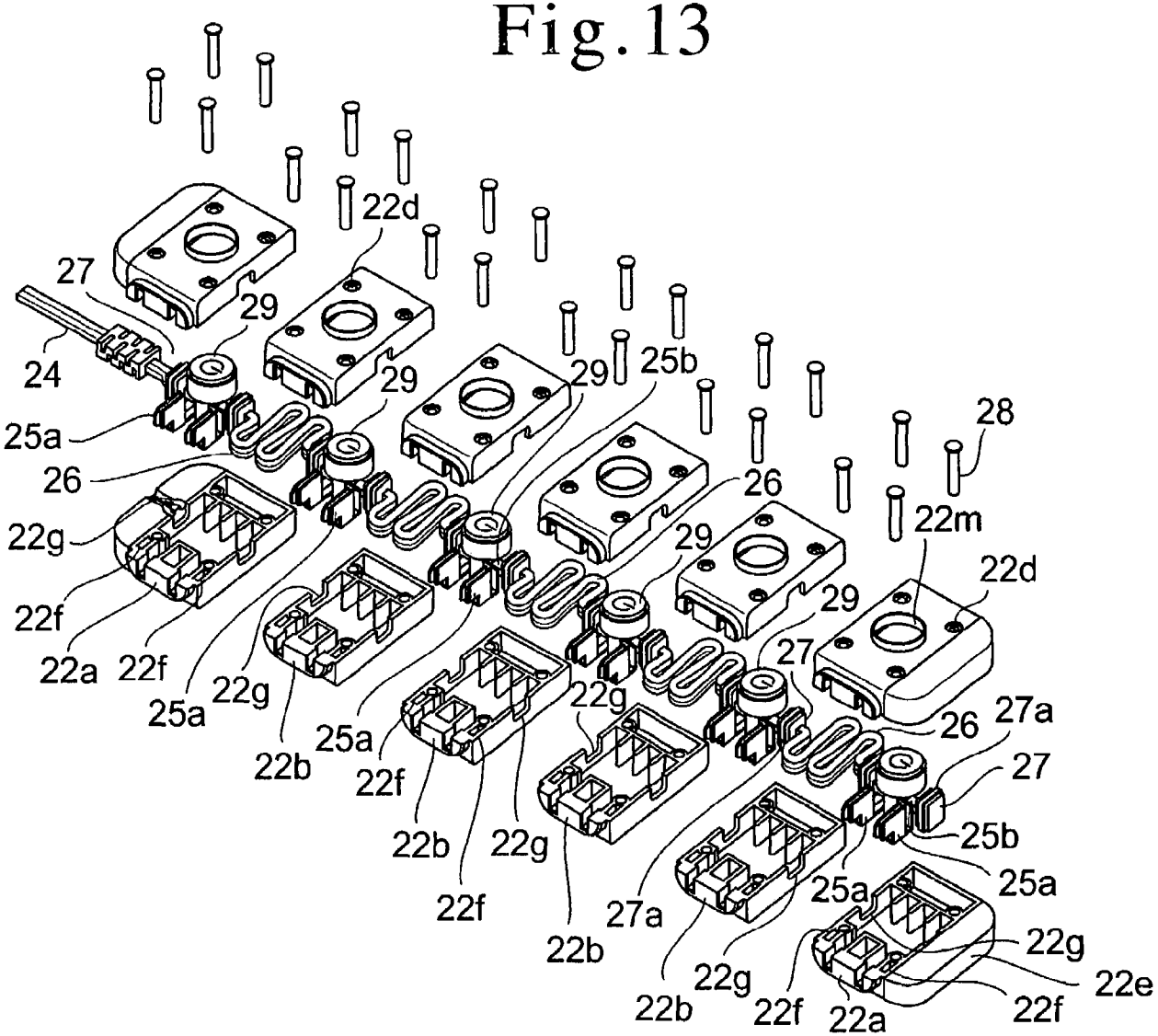
FIG. 13 is an exploded perspective view showing the internal structure of the power strip of FIG. 12.
Figure 14:
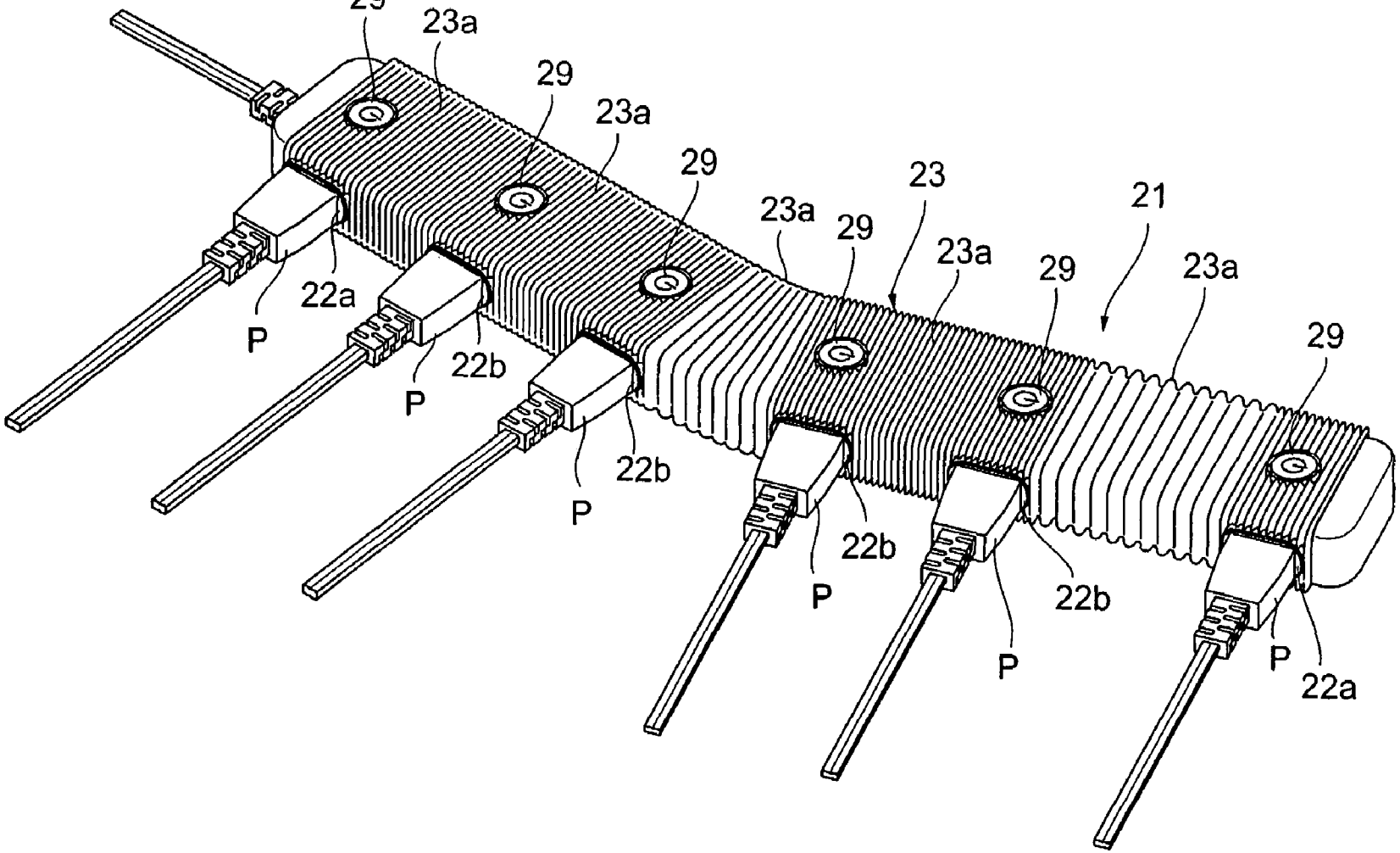
FIG. 14 is a perspective view showing an example of how the power strip of the FIG. 12 might be used.

A power strip 21 that is a third embodiment of the invention is shown in FIGS. 12 to 14. FIG. 12 is an overview of the power strip 21. The power strip 12 has a socket 22*a* at either end and a number of sockets 22*b* (four in the illustrated power strip 21) spaced between the two sockets 22*a*. The edge faces of the sockets 22*a*, 22*b* are formed with pairs of terminal insertion holes 22*c* for insertion of plugs. The regions surrounding of the sockets 22*a*, 22*b* are covered by a tubular cover 23 imparted with flexibility by formation of numerous corrugations 23*a*. The tubular cover 23 is given a rectangular tubular shape matched to the profile of the sockets 22*a*, 22*b*. A power cable 24 extends outward from the socket 22*a* at one end of the power strip 21. The extremity of the power cable 24 is equipped with a plug for insertion into a wall socket, for example. The power strip 21 is equipped with switches 29 associated with the individual sockets 22*a*, 22*b*.

The internal structure of the power strip 21 will now be explained with reference to FIG. 13. Each socket 22*a*, 22*b* has an overall split structure composed of assembled upper and lower members. As in the first embodiment, the shapes of the sockets 22*a* and sockets 22*b* are differentiated from the functional viewpoint. The sockets 22*a* are integrally formed at one end with an end member 22*e* exposed outward from the end of the cover 23. The sockets 22*b* are not formed end members 22*e*.

The surfaces of the end members 22*e* can be subjected to surface treatment (e.g., rubber coating treatment) so as to impart them with nonslip property. Instead of conducting such surface treatment, it is possible to form the end member 22*e* itself of rubber or the like and fasten it to the end portion of a member shaped like the socket 22*b* by bonding or force-fitting.

A terminal plate 25*a* is installed in association with each of the two terminal insertion holes 22*c* at each socket 22*a*, 22*b*. A first projection 25*b* and a first extension are formed at one end of each terminal plate 25*a*. The first projections 25*b* are fit into recesses 22*f* in the lower members (lower as viewed in the drawings) of the split structures. One of the two conductors of the power cable 24 is connected to the extension of the terminal plate 25*a* by crimping. Similarly to in the earlier embodiments, a cast resin spacer 27 is attached to the two conductors of the power cable 24 to insulate them from each other. The spacer 27 has the shape of a block integrally formed at its edge with an endless projection 27*a*. The projection 27*a* is positioned at the inside of rectangular notches 22*g* formed in the socket 22*a*. As in the earlier embodiments, the engagement of the projection 27*a* with the notches 22*g* prevents extraction of the power cable 24 and also prevents wire breakage under a strain-producing load. Similar effects are also realized by installing projections 7*a* in association with connecting cables 26 (see below).

A second extension and second projection 25*b* are integrally formed at the other end of each terminal plate 25*a*. One of the two conductors of a connecting cable 26 is connected to each second extension by crimping or the like. A cast resin spacer 27 is attached to the two conductors of the connecting cable 26. The spacer 27 is inserted into the notches 22*g* formed in the upper and lower members of the associated socket 22*a*, 22*b*. Each conductor of the connecting cable 26 is connected through a spacer 27 to the extension of the adjacent terminal plate 25*a*.

Each of the switches 29 is interposed between the two terminal plates 25*a* located at an associated pair of the terminal insertion holes 22*c*. Making and breaking of the switch 29 turns the electrical continuity with the terminal plates 25*a* ON and OFF. Each switch 29 is disposed between the conductors of the connecting cables 26 so that power supply to the terminal plates 25*a* in the terminal insertion holes 22*c* can be switched independently at each of the sockets 22*a*, 22*b*. A structure is adopted that enables toggling between a conductive state and a nonconductive state with each successive pressing of the switch 29.

The connecting cables 26 are folded. This is for providing the connecting cables 26 with a degree of expandability for accommodating positional changes between a socket 22*a* and a socket 22*b* or between sockets 22*b*. The folded configuration ensures that the connecting cables 26 do not get tangled or shifted before or after expansion or compression of the space between the sockets.

The terminal plates 25*a* installed in association with the six sockets 22*a*, 22*b* are interconnected by the connecting cables 26. The extensions of the terminal plates 25*a* nearest the tip end are attached with a spacer 27 that is inserted into the notches 22*g* formed in the upper and lower members of the associated socket 2*a*. This spacer 27 does not serve to prevent wire breakage.

After the six sets of terminal plates 25*a* and spacers 27 for the six sockets 22*a*, 22*b* have been clamped between the members of the split structures, pins 28 are inserted or forced into through-holes 22*d* formed at the four corners of the sockets 22*a*, 22*b* to integrally assemble the sockets 22*a*, 22*b*.

The upper faces of the upper members (upper as viewed in the drawings) of the sockets 22*a*, 22*b* are, as shown in FIG. 13, formed with through-holes 22*m* surrounded by vertical walls. As shown in FIG. 12, the cover 23 is formed at substantially regular intervals with six through-holes 23*b* for inserting the vertical walls of the through-holes 22*m*. The through-holes 23*b* are of a size and shape matching the through-holes 22*m*. After the sockets 22*a*, 22*b* have been assembled in the foregoing manner, the peripheral edges of through-holes 22*m* of the sockets 22*a*, 22*b* are inserted into the through-holes 23*b* of the cover 23 to attach the cover 23 to the outer peripheral surface of the sockets 22*a*, 22*b*. The corrugations are initially compressed to minimize the space between them, and the sockets 22*a*, 22*b* are interconnected and maintained at regular intervals by the cover 23.

As in the earlier embodiments, the cover 23 attached to cover the sockets 22*a*, 22*b* is tubular. Therefore, the sockets 22*a*, 22*b* are internally accommodated in a substantially sealed state and the connecting cables 26 interconnecting the sockets 22*a*, 22*b* are accommodated in a freely expandable and contractible condition.

As in the first embodiment, the cover 23 can be bonded to the outer peripheral surface of the sockets 22*a*, 22*b* using an adhesive or can simply fit over the sockets 22*a*, 22*b*.

The surfaces of the sockets 22*a*, 22*b* can be smooth as shown in FIG. 13 or, while not illustrated, the outer peripheral surfaces of the sockets 22*a*, 22*b* can, as in the first embodiment, be formed with many encircling grooves to create bumps and dips that match the corrugations 23*a* of the cover 23. The encircling grooves and the corrugations 23*a* of the cover 23 engage to prevent shifting when the cover 23 is expanded or compressed. When the sockets 22*a*, 22*b* and the cover 23 are integrally adhered using an adhesive, tight adhesion is achieved owing to the encircling grooves. This heightens the bonding strength and makes detachment unlikely.

As shown in FIG. 14, it is possible by stretching corrugations 23*a* located between adjacent sockets 22*a*, 22*b* in the longitudinal direction of the power strip 21 to expand the spaces between the sockets 22*a*, 22*b* and thus expand the distances between adjacent pairs of terminal insertion holes 22*c*.

The advantageous effects achieved by the power strip 21 will be explained. For example, as shown in FIG. 14, the corrugations 23*a* between the third and fourth sockets 22*b* from the tip end can be bent to bend this portion left and right. The bending of the power strip 21 in this manner makes it possible to avoid interference with peripheral devices installed near the power strip 21 and to increase installation stability by bending the power strip 21 into a V-like shape. Although not illustrated, one, two or more sets of the corrugations 23*a* can be bowed so as to project these portions upward. The bowing of the power strip 21 in this manner forms a gap under the bowed portion that can be utilized to avoid interference with a part, cable or the like situated underneath.

Moreover, it is possible, for example, to stretch the corrugations 23*a* between the first and second sockets from the tip end, as shown in FIG. 14. This enables a large AC adapter A or the like to be plugged into a pair of terminal insertion holes 22*c* (socket) without obstructing neighboring sockets and also facilitates the insertion and extraction of plugs P. Although FIG. 14 shows only plugs P plugged into the sockets 22*a*, 22*b*, this is only and example and it is of course also possible to plug in an AC adapter A and to expand, compress, bend or bow the corrugations 23*a* between the sockets 22*a*, 22*b*.

Figure 15:
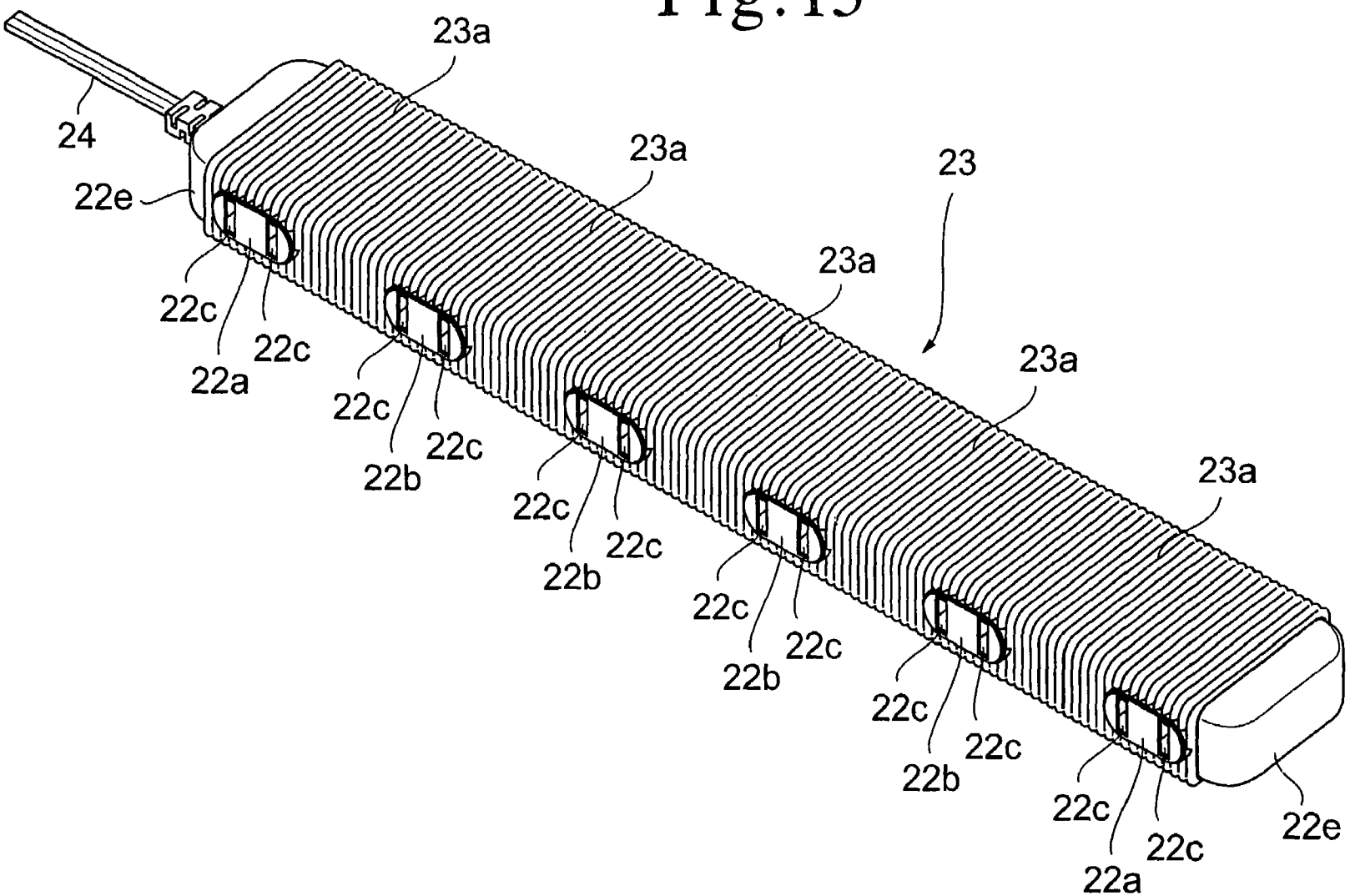
FIG. 15 is a perspective overview of a modification of the power strip of FIG. 12.
Figure 16:
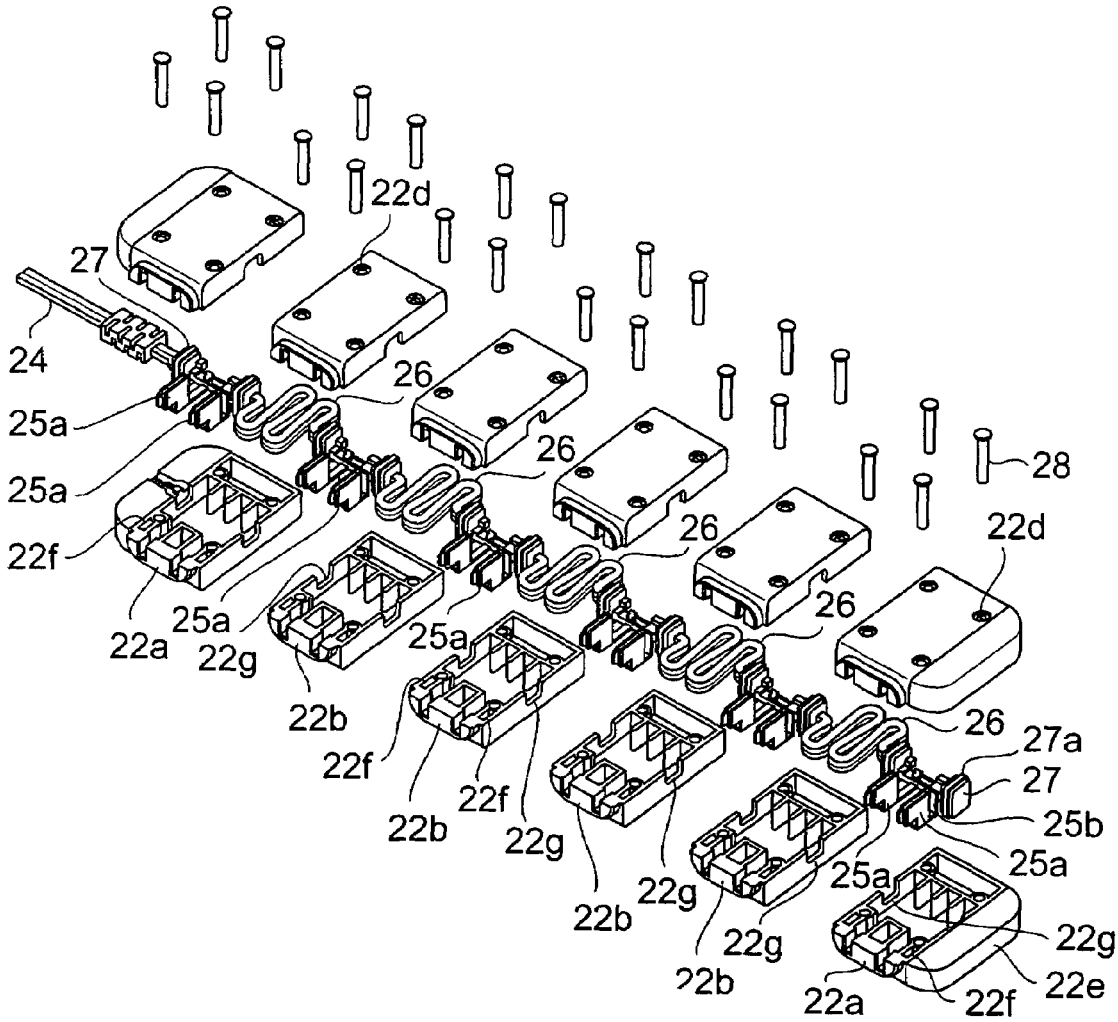
FIG. 16 is an exploded perspective view showing the internal structure of the power strip of FIG. 15.

Although the power strip 21 is provided with the switches 29 for turning the sockets 22*a*, 22*b* ON and OFF, it is also possible, as shown in FIGS. 15 and 16, to adopt a configuration not including the switches 29. In such a case, as shown in FIG. 16, the sets of terminal plates 25*a* are constantly in connection with the associated connecting cables 26.

Fourth Embodiment

Figure 17:
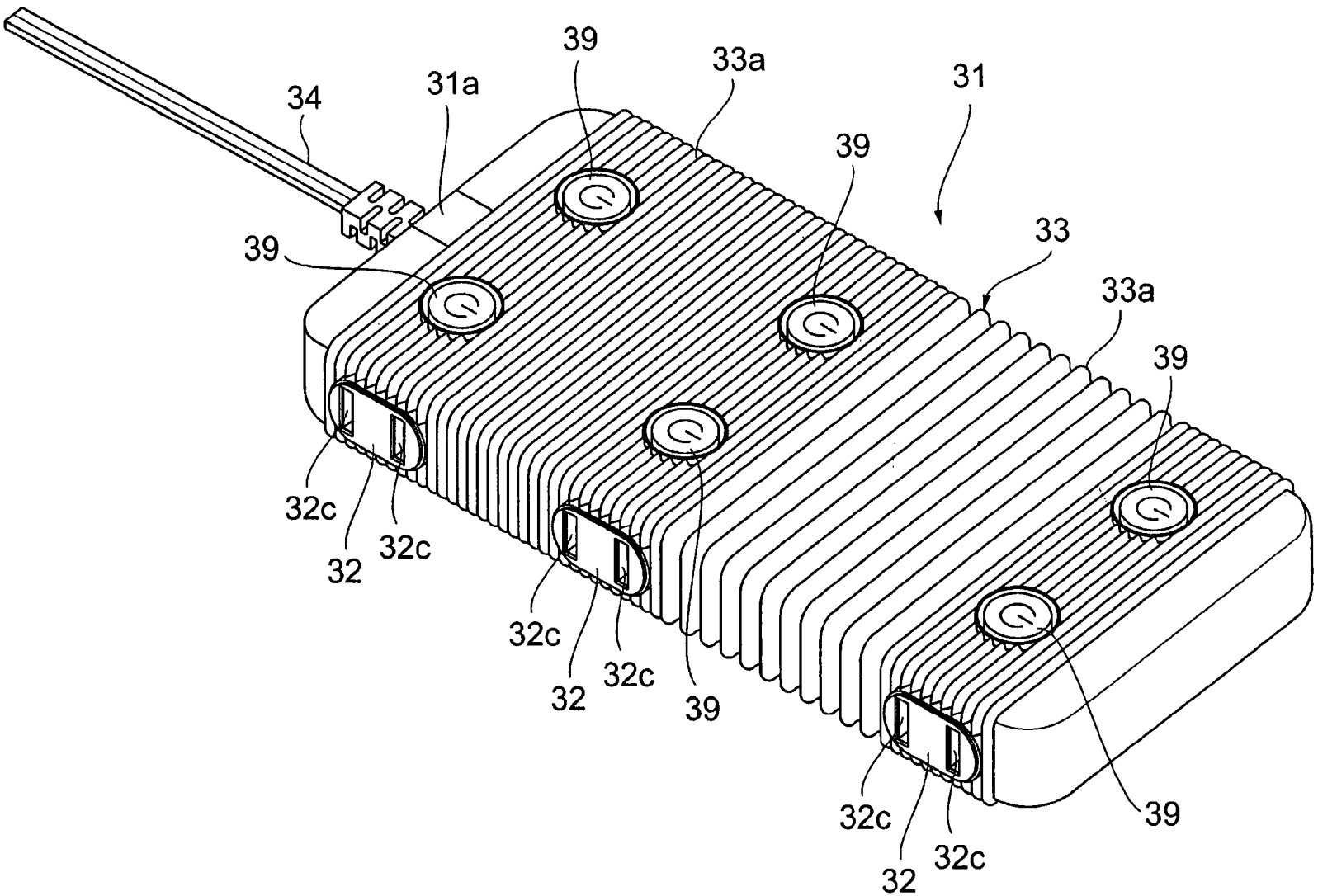
FIG. 17 is a perspective overview of a power strip that is a fourth embodiment of the invention.

A power strip 31 that is a fourth embodiment of the invention is shown in FIG. 17. The power strip 31 is a block-like body equipped on each of first and second edge surfaces with three sockets 32 structured like those of the power strip 21 according to the third embodiment. Only the first edge surface is visible in FIG. 17. The other edge surface is the one on the opposite side of the block from (behind) the first edge surface. The sockets 32 are formed at corresponding locations on the two edge surfaces in back-to-back orientation. The back-to-back sockets 32 formed on the first and second edge surfaces of the power strip 31 are aligned on the respective edge surfaces so that their pairs of terminal insertion holes 32*c* fall approximately on the same imaginary line. The two imaginary lines lie substantially in parallel separated by a prescribed distance. Similarly to in the preceding embodiment, the upper surface of the power strip 31 is provided with switches 39 that are associated with the respective sockets 32 and can be used to turn the sockets 32 ON/OFF independently.

The outer peripheral surfaces of the sockets 32 are covered by a cover 33 having corrugations 33*a*. The corrugations 33*a* extend perpendicular to the direction of socket 32 alignment to completely encircle the power strip 31. As illustrated in FIG. 17, this arrangement enables the spacing between the sockets 32 formed on the first and second edge surfaces to be flexibly expanded and compressed in the direction of the imaginary lines. Although FIG. 17 shows only how the sockets 32 can be moved toward and away from each other, the power strip 31 according to the fourth embodiment also enables bending and bowing at the corrugations 33*a* similar to that in the power strip 1 and the like.

The internal structure of the power strip 31 is similar to that of the power strip 21 according to the third embodiment. The two conductors of a power cable 34 are connected to the sockets 32 through their associated switches 39. The power cable 34 is coupled with the main unit of the power strip 31 by attachment through a rotatable coupling 31*a*, thereby enabling the power cable 34 to follow deformation of the power strip 31 in a desired manner.

Fifth Embodiment

Figure 18:
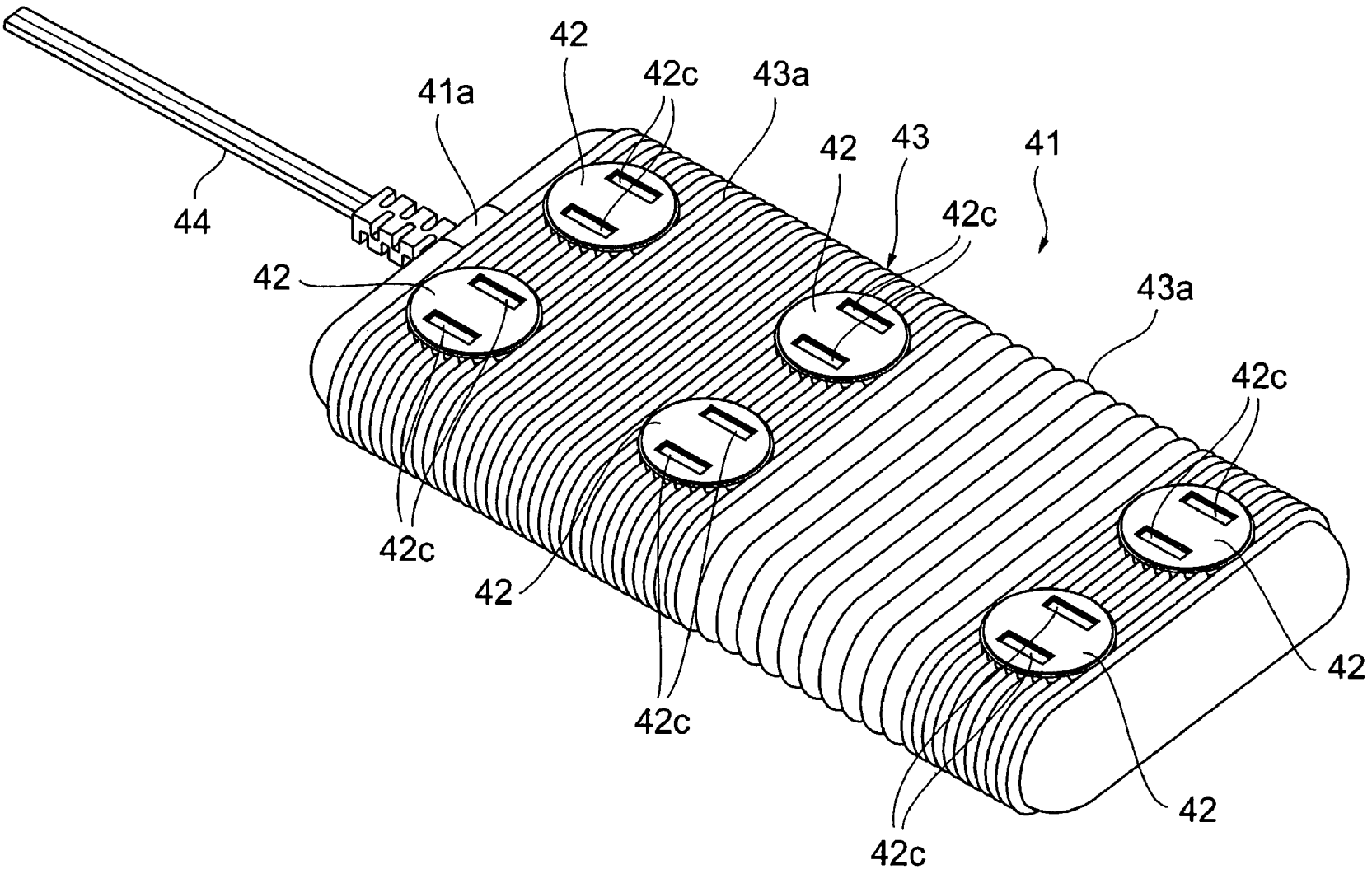
FIG. 18 is a perspective overview of a power strip that is a fifth embodiment of the invention.

A power strip 41 that is a fifth embodiment of the invention is shown in FIG. 18. The power strip 41 is equipped with first socket groups each including three sockets 42 whose pairs of terminal insertion holes 42*c* fall on imaginary lines and second socket groups each including two sockets 42 whose pairs of terminal insertion holes 42*c* lie substantially parallel as separated by a prescribed distance in a direction intersecting the imaginary lines.

The outer peripheral surfaces of the sockets 42 are covered by a cover 43 having corrugations 43*a*. The corrugations 43*a* extend perpendicular to the direction of imaginary lines to completely encircle the power strip 41. As illustrated in FIG. 18, this arrangement enables the spacing between the sockets 42 to be flexibly expanded and compressed in the direction of the imaginary lines. Although FIG. 18 shows only how the sockets 32 can be moved toward and away from each other, the power strip 41 according to the fourth embodiment can, like the power strip 1 and the like, be bent and bowed to establish three-dimensional forms.

The internal structure of the power strip 41 is similar to that of the power strip 1 according to the first embodiment. The two conductors of a power cable 44 are connected to the sockets 42. The power cable 44 is coupled with the main unit of the power strip 41 by attachment through a rotatable coupling 41*a*, thereby enabling the power cable 44 to follow deformation of the power strip 41 in a desired manner.

Sixth Embodiment

Figure 19:
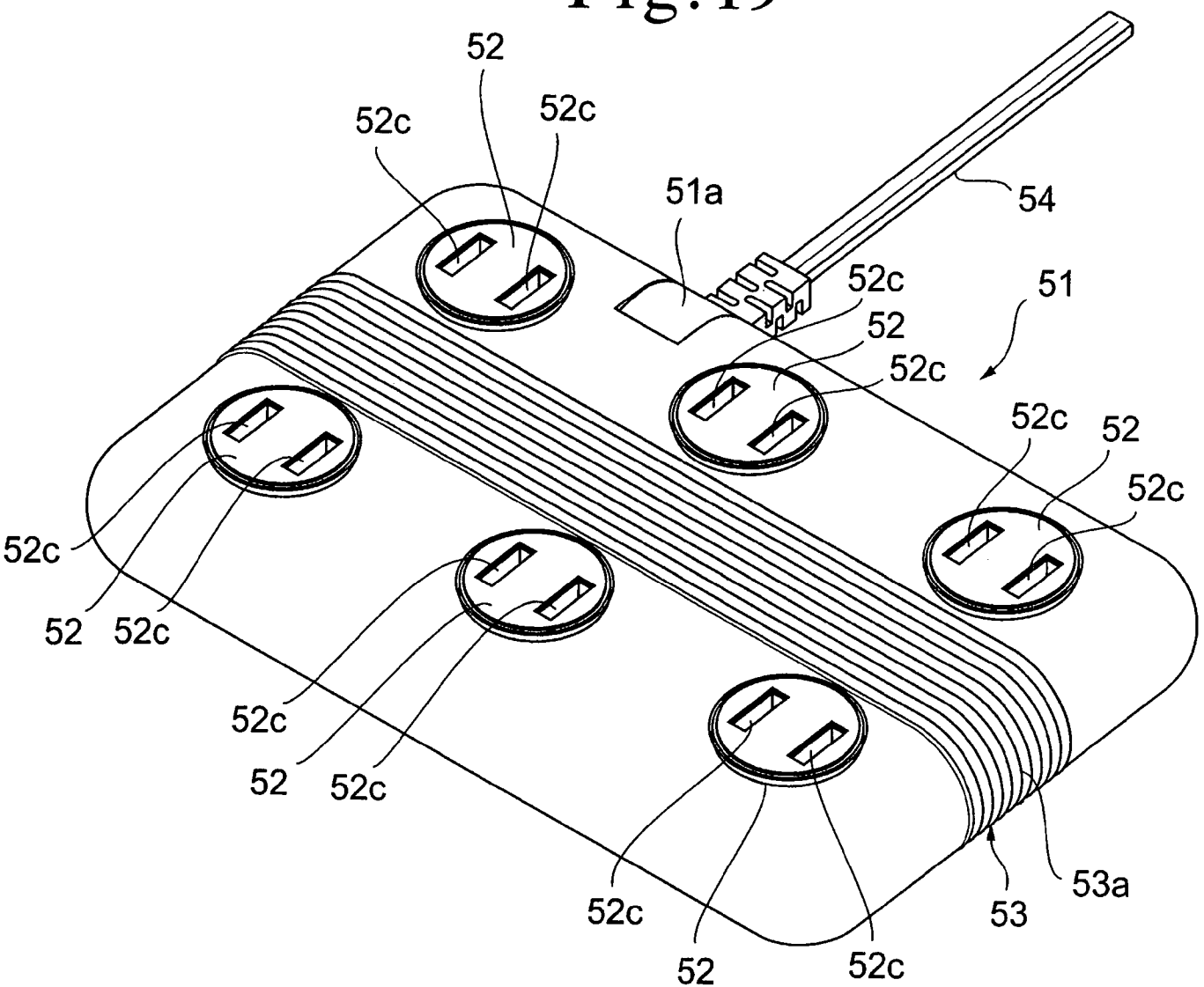
FIG. 19 is a perspective overview of a power strip that is a sixth embodiment of the invention.

A power strip 51 that is a sixth embodiment of the invention is shown in FIG. 19. The power strip 51 is equipped with first socket groups each including two sockets 52 whose pairs of terminal insertion holes 52*c* fall on imaginary lines and second socket groups each including three sockets 52 whose pairs of terminal insertion holes 52*c* lie substantially parallel as separated by a prescribed distance in a direction intersecting the imaginary lines.

A joint 53 formed with corrugations 53*a* is provided between the sockets 52 arranged in two columns. The corrugations 53*a* extend in parallel with the columns to completely encircle the power strip 51. This arrangement enables the spacing between the two columns of sockets 52 to be flexibly expanded and compressed. It is possible not only to expand and compress the spacing between the sockets 52 but also to establish a desired three-dimensional form by bending and bowing at the corrugations 43*a*.

Figure 20:
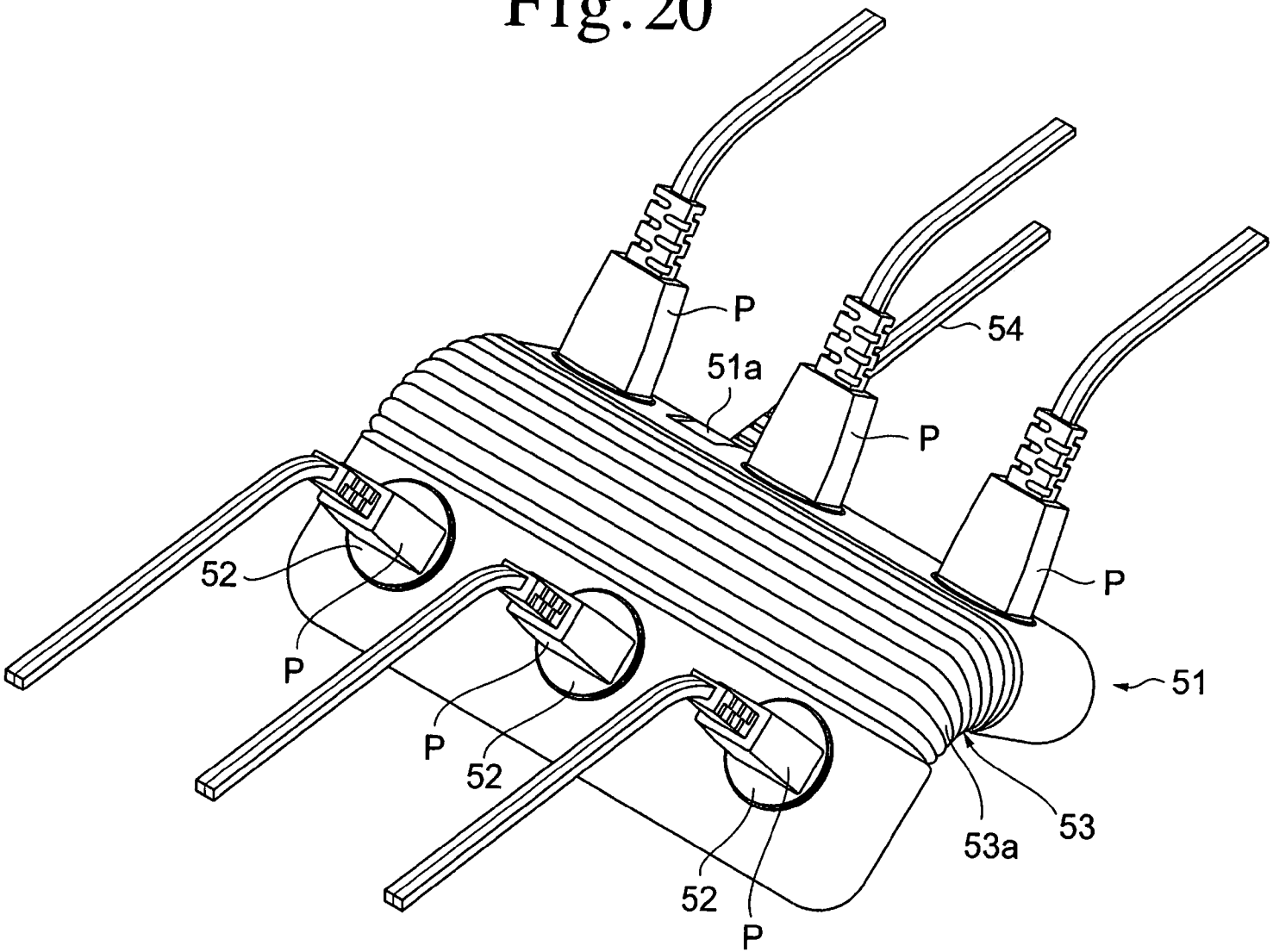
FIG. 20 is a perspective view showing an example of how the power strip of the FIG. 19 might be used.

For example, as shown in FIG. 20, the joint 53 of the power strip 51 can be bent to give the power strip 51 an inverted V-like shape as viewed in cross-section. The power strip 51 can be used in this condition to supply power to devices whose plugs P or the like are plugged into the terminal insertion holes 52*c*. When the power strip 51 is bent into an inverted V-like shape, it is given a given a more pronounced vertical dimension than in its flat condition shown in FIG. 19. This enhanced three-dimensionality upgrades installation stability. It also enables plugs P to be inserted and extracted from slanted sides. This can be expected to increase operability (ease of use) because it makes plug insertion and extraction easier than in the flat condition. Moreover, the cables associated with the plugs can be extended in the desired direction without putting them under strain.

The internal structure of the power strip 51 is similar to that of the power strip 1 according to the first embodiment. The two conductors of a power cable 54 are connected to the sockets 52. The power cable 54 is coupled with the main unit of the power strip 51 by attachment through a rotatable coupling 51*a*, thereby enabling the power cable 54 to follow deformation of the power strip 51 in a desired manner.

The outer surfaces at the regions where the sets of three sockets 52 are formed and/or the outer surface of the joint 53 can be subjected to surface treatment (e.g., rubber coating treatment) so as to impart them with nonslip property.

Other Embodiments

In the power strips according to the foregoing embodiments, the sockets (2*a*, 2*b* etc.) are formed by provisionally joining upper and lower members of a split structure and uniting them by force-fitting the pins 8. Alternatively, it is possible to form the surfaces of the upper and lower members with mating fastener members and unite them by engaging the fastener elements.

The power strip 1 according to the first embodiment has the outer peripheral surfaces of its sockets 2*a*, 2*b* formed with bumps and dips matched to the corrugations 3*a* of the cover 3 (see FIG. 5). However, it is not necessary to form the bumps and dips in a number corresponding to the total number of corrugations 3*a*. In other words, the bumps and dips can be provided in a number less than the number of corrugations 3*a* and brought into engagement with only some of the corrugations 3*a*.

Moreover, it is not necessary to form continuous bumps and dips in the manner of encircling grooves matched to the corrugations 3*a*. For example, it is possible instead to provide along the direction of the corrugations 3*a* discrete sets of multiple projections spaced in the direction of the corrugations 3*a*.

When the cover 3 or the joints 13 shown in FIG. 10 are molded integrally with the sockets (2*a*, 2*b* etc.), the tip region of the bumps and dips formed on the joints is preferably formed with a head, formed with a reverse taper or similarly structured.

In foregoing description of the power strips 1, 11, 21, 31, 41, 51, the material, surface treatment and other such characteristics of the joints 13, 53, the covers 3, 23, 33, 43, and the sockets 2*a*, 2*b*, 12*a*, 12*b*, 22*a*, 22*b*, 32, 42, 52 were not discussed in detail. Use of vinyl chloride, polystyrene, silicon resin or other such synthetic resin injection-moldings for these members is preferable from the viewpoint of fabrication process and cost.

It is also possible to make the joints 13, 53 and covers 3, 23, 33, 43 of an elastically deformable material such as natural rubber or synthetic rubber. Fabrication using such an elastic material is preferable because it enables easy and reliable connection of the joints 13, 53 and covers 3, 23, 33, 43 with the joints. In addition, the nonslip effect imparted by natural rubber, synthetic rubber or the like lowers the probability of the installed power strip being moved or caused to slip and fall off its supporting surface. When the aim is solely to achieve a nonslip effect, it suffices to provide at least the outer surfaces of the covers 3, 23, 33, 43 and/or the joints 13, 53 with a rubber coating or to subject them to nonslip processing or treatment.

Similarly, the portions of the outer surfaces the aforesaid sockets 2*a*, 2*b*, 12*a*, 12*b*, 22*a*, 22*b*, 32, 42, 52 exposed outside the aforesaid joints 13, 53 or covers 3, 23, 33, 43 can be subjected to a nonslip processing or treatment such as provision of a rubber coating.

If the cover and joints are flexible, they can be so-called nested assemblies composed of at least two members bridging the joints.

The cover and joints can also be made of metal or plastic strip material helically wound into a tubular shape to be capable of bending and bowing. For example, they can be fabricated in the form of a flexible metal hose.

The power strips of foregoing embodiments were described as being provided with tubular covers and joints. However, the covers and joints can instead be formed of complementary upper and lower members that are welded or bonded together.

In the description of the power strips of the foregoing embodiments, it was explained that the cover and joints are assembled. Instead, however, it is possible to place preassembled sockets in a forming die and form the cover or joints integrally with the sockets by injecting resin into the surrounding region.

It is also possible to form nested regions where adjacent sockets intermesh, utilize the nested regions as reinforced core members, and cover the combined nested regions with a flexible cover or joints as explained with respect to the foregoing embodiments.

The power strips of the foregoing embodiments include ones provided with switches associated with the individual sockets. It is also possible to provide a switch in the region where the power cable passes out of the power strip main unit, for example, to enable multiple the sockets to be turned ON/OFF in unison.

The power strips according to the foregoing embodiments can be provided with additional features such as a mechanism for preventing accidental extraction of plugs from the sockets, a structure for attaching a ground wire, and an internal circuit for protecting against surge currents.

INDUSTRIAL APPLICABILITY

As explained in the foregoing, the power strip of this invention has its sockets interconnected by joints or a cover. Therefore, when a large AC adapter is to be plugged in, the space between neighboring sockets can be expanded to ensure that no unused socket gets hidden under the AC adapter. Moreover, the spaces between the sockets can be expanded to form sufficient space for finger insertion when inserting or pulling out an AC adapter or plug, thereby making insertion and extraction easy. Moreover, the length of the power strip can be reduced to minimum for easy installation or carrying by compressing the spaces between the sockets to near minimum. In addition, the power strip can be bent and/or twisted to deform it into a bent or bowed shape optimized to the installation site, thereby increasing its stability at the installation site. Such bending and bowing also makes it possible to extend power cables in the desired direction without putting them under strain, thereby preventing cable wire breakage and the like. The tubular shape of the joints or cover enables a cable and the like to be passed through the interior for establishing electrical connection among the sockets. The formation of the joints or cover with corrugations enables the spaces between the sockets to be expanded or compressed and the sockets to be bent and twisted relative to one another. The bumps and dips formed on the sockets mesh with at least part of the cover, thereby preventing the sockets and cover from shifting relative to one another. Since the cover is not formed with corrugations at the portions in the region of the sockets, these portions of the cover can be brought into close contact with surface of the associated sockets insofar as the socket surfaces are smooth. Reliable adhesion or bonding can therefore be achieved. The outer peripheral surfaces of the sockets are formed with the bumps and dips that mesh with the corrugations. Therefore, when covering the sockets with the cover, it is possible at the sockets to mesh the corrugations of the cover and the bumps and dips of corrugated shape of the sockets, thereby integrating them. Moreover, if the corrugations and the bumps and dips are bonded, the cover and the sockets are closely contacted in a fitted manner to reduce shifting. A nonslip property is imparted by subjecting the outer surface of the joints or cover, or the portions of the outer surfaces of the sockets exposed outside the joints or cover, to nonslip processing or treatment or by forming them of material having a nonslip effect. This inhibits inadvertent movement of the power strip by producing a frictional action when a load tending to move the power strip acts thereon. A flexing action can be produced that causes the sockets to approach and depart from one another in the direction of an imaginary line. A flexing action can be produced that causes the sockets to approach and depart from one another in a direction intersecting the imaginary line. Flexing actions can be produced that cause the sockets to approach and depart from one another in the direction of the imaginary line and cause the sockets to approach and depart from one another in the direction intersecting the imaginary line. The joints or cover can, for example, be integrated with the sockets by a bonding process or molding process. This improves bonding strength and bonding quality and also enhances productivity.

What is claimed is:

1. A power strip, comprising:

two or more spaced-apart socket sections each having a set of terminal insertion holes configured to receive plug terminals of a power cable;

at least one flexible joint section that intersects adjacent socket sections; and a flexible cover section substantially covering the spaced-apart socket sections, wherein an entire circumference of the cover section or joint section is formed with corrugations that perpendicularly intersect a longitudinal direction of the cover section.

2. The power strip according to claim 1, wherein the joint section or cover section has a substantially tubular shape.

3. The power strip according to claim 1, wherein the joint section or cover section has a tubular shape, and the tubular shape comprises the corrugations.

4. The power strip according to claim 1, wherein an outer surface of the joint section or cover section, or portions of outer surfaces of the socket sections exposed outside the joint section or cover section, are subjected to nonslip processing or treatment, or at least surface layers thereof are formed of a material having a nonslip effect.

5. The power strip according to claim 1, wherein the set of terminal insertion holes formed at the socket sections fall along an imaginary line and the joint section or cover section has a structure enabling it to flex at least along the imaginary line.

6. The power strip according to claim 1, wherein the set sets of terminal insertion holes formed at the socket sections fall along an imaginary line and the joint section or cover section has a structure enabling it to flex at least along a direction perpendicularly intersecting the imaginary line.

7. The power strip according to claim 1, which includes a set of sockets whose sets of terminal insertion holes are formed at the socket sections to be located along an imaginary line and a set of sockets whose set of terminal insertion holes are formed at the socket sections to be located substantially in parallel as spaced a prescribed distance apart in a direction perpendicularly intersecting the imaginary line, in which power strip it is either possible for the joint section or cover section to flex at least along the imaginary line or possible for the joint section or cover section to flex at least along the direction perpendicularly intersecting the imaginary line.

8. The power strip according to claim 1, wherein the joint section or cover section is integrally connected and fastened to the socket section.

9. The power strip according to claim 1, wherein outer peripheral surfaces of the socket sections are formed with bumps and dips that mesh with the cover section or joint section.

10. The power strip according to claim 9, wherein the bumps and dips have an undulating shape that fits into the corrugations of the cover section or joint section.

* * * * *